US008138472B2

(12) United States Patent
Chen et al.

(10) Patent No.: US 8,138,472 B2
(45) Date of Patent: Mar. 20, 2012

(54) MOLECULAR ION ACCELERATOR

(75) Inventors: Chung Hsuan Chen, Taipei (TW); Jung-Lee Lin, Banciao (TW); Nien-Yeen Hsu, Taipei (TW); Yi-Sheng Wang, Taipei (TW)

(73) Assignee: Academia Sinica, Taipei (TW)

( * ) Notice: Subject to any disclaimer, the term of this patent is extended or adjusted under 35 U.S.C. 154(b) by 190 days.

(21) Appl. No.: 12/431,896

(22) Filed: Apr. 29, 2009

(65) Prior Publication Data

US 2010/0276582 A1 Nov. 4, 2010

(51) Int. Cl.
*H01J 49/40* (2006.01)

(52) U.S. Cl. ..... 250/282; 250/281; 250/287; 250/290; 250/291; 250/292

(58) Field of Classification Search ..... 250/281, 250/282, 287, 290, 291, 292
See application file for complete search history.

(56) References Cited

U.S. PATENT DOCUMENTS

| | | | | |
|---|---|---|---|---|
| 5,572,022 | A | 11/1996 | Schwartz | |
| 5,591,969 | A | 1/1997 | Park et al. | |
| 5,808,300 | A * | 9/1998 | Caprioli | 250/288 |
| 6,262,638 | B1 | 7/2001 | Scherer | |
| 6,646,256 | B2 | 11/2003 | Gourley et al. | |
| 6,900,431 | B2 * | 5/2005 | Belov et al. | 250/282 |
| 6,906,320 | B2 | 6/2005 | Sachs et al. | |
| 7,084,396 | B2 | 8/2006 | Schneider | |
| 7,161,147 | B1 | 1/2007 | Chang et al. | |
| 7,329,866 | B2 | 2/2008 | Wang | |
| 2003/0122070 | A1 | 7/2003 | Chang et al. | |
| 2005/0153341 | A1 | 7/2005 | Alexander | |
| 2006/0284074 | A1 | 12/2006 | Chang et al. | |
| 2007/0131871 | A1 | 6/2007 | Chang et al. | |
| 2007/0272852 | A1 | 11/2007 | Miller | |
| 2008/0149821 | A1 | 6/2008 | Senko | |

FOREIGN PATENT DOCUMENTS

WO WO2008/042949 (A2) 4/2008

OTHER PUBLICATIONS

NASA's Jet Propulsion Laboratory, "Induction Charge Detector With Multiple Sensing Stages" (Jan. 1, 2008).
W. Aberth et al., "Secondary ion mass spectrometry with cesium ion primary beam and liquid target matrix for analysis of bioorganic compounds," *Anal. Chem.* 54:2029-2034 (1982).
A. Adams and F. H. Read, "Electrostatic cylinder lenses II: Three element einzel lenses," *Journal of Physics E: Scientific Instruments* 5:150-155 (1972).
A. Adams and F. H. Read, "Electrostatic cylinder lenses III: Three element asymmetric voltage lenses," *Journal of Physics E: Scientific Instruments* 5:156-160 (1972).
B. Bothner et al., "Electrospray ionization of a whole virus: analyzing mass, structure, and viability," *ChemBioChem* 5:258-60 (2004).
Y. Cai et al. "Ion trap mass spectrometry of fluorescently labeled nanoparticles," *Anal. Chem.* 75:1805-11 (2003).

(Continued)

*Primary Examiner* — David A Vanore
(74) *Attorney, Agent, or Firm* — Eckman Basu LLP

(57) ABSTRACT

A novel system and methods for accelerating analytes including, without limitation, molecular ions, biomolecules, polymers, nano- and microparticles, is provided. The invention can be useful for increasing detection sensitivity in applications such as mass spectrometry, performing collision-induced dissociation molecular structure analysis, and probing surfaces and samples using accelerated analyte.

30 Claims, 23 Drawing Sheets

OTHER PUBLICATIONS

J. L. Campbell et al., "Analysis of polyethylene by using cyclopentadienyl cobalt chemical ionization combined with laser-induced acoustic desorption/fourier transform ion cyclotron resonance mass spectrometry," *Anal. Chem.* 77: 4020-6 (2005).
R. Chen et al., "Trapping, detection, and mass determination of coliphage T4 DNA ions of $10^8$ Da by electrospray ionization fourier transform ion cyclotron resonance mass spectrometry", *Anal. Chem.* 67: 1159-1163 (1995).
S.D. Fuerstenau et al., "Molecular weight determination of mega-Dalton electrospray ions using charge detection time-of-flight mass spectrometry," *Rapid Comm. Mass Spectrom.,* 9:1528-1538 (1995).
S. D. Fuerstenau et al., "Mass spectrometry of an intact virus," W. H. Benner, J. J. Thomas, C. Brugidou, B. Bothner, G. Siuzdak, *Angew. Chem. Int. Ed.* 40: 542-4 (2001); Corrigendum: *Angew. Chem. Int. Ed.* 40: 982 (2001).
S.D. Fuerstenau, "Whole Virus Mass Analysis by Electrospray Ionization," *J. Mass. Spectrom. Soc. Japan.,* 51:50-53 (2001).
P. W. Geno et al., "Secondary electron emission induced by impact of low-velocity molecular ions on a microchannel plate," *Int. J. Mass Spectrom. Ion Processes* 92: 195-210 (1989).
V. V. Golovlev et al., "Laser-induced acoustic desorption," *Int. J: Mass Spectrom. Ion Processes* 169/170: 69-78 (1997).
V. V. Golovlev et al., "Laser-induced acoustic desorption of electrons and ions", *Appl. Phys. Lett.* 71: 852-854 (1997).
E. Harting and F. H. Read, *Electrostatic Lenses,* Preface, Chapters 1, 2, and 4, and References, pp. v-vi, 1-17, 25-29, and 42, Elsevier, New York, 1976.
E. de Hoffmann and V. Stroobant, *Mass Spectrometry: Principles and Applications,* Chapters 1-3, 3rd Ed., John Wiley & Sons Inc., 2007.
M. Karas et al., "Laser desorption ionization of proteins with molecular masses exceeding 10,000 Daltons," *Anal. Chem.,* 60:2299-301 (1988).
J. L. Jimenez et al., "Ambient aerosol sampling using the Aerodyne aerosol mass spectrometer," *J. Geophys. Res. Atmos.* 108: 8425-37 (2003).
K. M. Lue et al., "Quadrupole mass spectrometer measurements of electrostatic sprays," *Inst. Phys. Conf. Series* 85: 337-342 (1987).
Mohammed A. Meetani et al., "Desorption electrospray ionization mass spectrometry of intact bacteria," *Journal of Mass Spectrometry,* 42:1186-1193 (2007).
Z. Nie et al., "Microscopy-based mass measurement of a single whole virus in a cylindrical ion trap," *Angew. Chem. Int. Ed.* 45: 8131-8134 (2006).
Wen-Ping Peng et al., "Molar mass and molar mass distribution of polystyrene particle size standards," *Anal. Chem.,* 77: 7084-7089 (2005).
Wen-Ping Peng et al., "Laser-Induced Acoustic Desorption Mass Spectrometry of Single Bioparticles," *Angewandte Chemie,* 118:1451-1457 (2006).
Wen-Ping Peng et al., "Charge-Monitoring Laser-Induced Acoustic Desorption Mass Spectrometry for Cell and Microparticle Mass Distribution Measurement," *Angew. Chem. Int. Ed.,* 46:3865-3869 (2007).
F. H. Read, "Accurate calculations of double-aperture electrostatic immersion lenses," *Journal of Scientific Instruments* (*Journal of Physics E*), 2:165-169 (1969).
F. H. Read, "Calculated properties of electrostatic einzel lenses of three apertures," *Journal of Scientific Instruments* (*Journal of Physics E*), 2:679-684 (1969).
F. H. Read, A. Adams and J. R. Soto-Montiel, "Electrostatic cylinder lenses I: Two element lenses," *Journal of Physics E: Scientific Instruments,* 4:625-632 (1970).
R. Redmer, "Physical properties of dense, low-temperature plasmas," *Phys. Reports,* 282:35-157 (1997).
L. Salsac, et al., "Glow Discharges: Glow Discharges in low-pressure gases," SARL Atout & Progrés, Paris, France (Parts first published Oct. 17, 2006, and Sep. 12, 2007).
J. C. Schultz et al., "Mass determination of megadalton-DNA electrospray ions using charge-detection mass spectrometry," *J. Am. Soc. Mass Spectrom.* 9: 305-313 (1998).
R. C. Shea et al., "Characterization of laser-induced acoustic desorption coupled with a fourier transform ion cyclotron resonance mass spectrometer," *Anal. Chem.* 78: 6133-9 (2006).
H. Shelton et al., "Electrostatic acceleration of microparticles to hypervelocities," *J. Appl. Phys.* 31: 1243-46 (1960).
G. Siuzdak, *The Expanding Role of Mass Spectrometry in Biotechnology,* 2nd Ed. MCC Press, San Diego. Chapters 1-2 (2006).
J. Somuramasami et al., "Evaluation of a Novel Approach for Peptide Sequencing: Laser-Induced Acoustic Desorption Combined with $P(OCH_3)_2^+$Chemical Ionization and Collision-activated Dissociation in a Fourier Transform Ion Cyclotron Resonance Mass Spectrometer," *J Am Soc Mass Spectrom.* 18:525-40. (Mar. 2007) (Epub Dec. 6, 2006).
K. Tanaka et al., "Protein and polymer analyses up to *m/z* 100 000 by laser ionization time-of-flight mass spectrometry," *Rapid Commun. Mass Spectrom.* 2: 151-153 (1988).
M. A. Tito et al., "Electrospray time-of-flight mass spectrometry of the intact MS2 virus capsid," *J. Am. Chem. Soc.* 122: 3550-51 (2000).
S. F. Wong et al., "Multiple charging in electrospray ionization of poly(ethylene glycols)," *J. Phys. Chem.* 92, 546-50 (1988).
Qin, Anal Chem 1996 vol. 68, pp. 2108-2112.

* cited by examiner

MOLECULAR ION ACCELERATOR

The invention disclosed herein generally relates to acceleration of a molecular ion to high kinetic energy and applications of such accelerated molecular ions. These applications include mass spectrometry; genomics and/or proteomics; structure determination of large molecules, including polymers and large biomolecules; and the analysis of surfaces and samples, including samples used in medical diagnostics and biomedical research.

Analyses of mass, mass distribution, and molecular structure are important in many fields, including biomedical research and diagnostics, proteomics, polymer chemistry, and nanotechnology. Determination of what is in a sample, one of the most simple questions and yet potentially one of the most challenging tasks in any chemical or biochemical project, can be subject to a number of limitations, including limitations of detection sensitivity. If multiple species are present in unequal proportions, or if a species is present at a very low concentration, detection may be quite difficult. When a sample contains a distribution of molecules or particles of variable mass, determining the shape of that distribution precisely can be useful, such as, for example, in optimizing methods of synthesis of the molecules or particles, or in optimizing downstream uses. The more sensitive the analytical method is, the less abundant or concentrated the sample may be in order to obtain useful results.

One general type of analysis of molecular structure involves fragmentation; by breaking a large molecule into smaller pieces, one can gain information about parent architecture by studying or analyzing the smaller, more tractable pieces.

Particle accelerators have been major tools in particle, nuclear, and atomic physics since they were developed early in the era of modern physics. The present disclosure relates to a system and method for acceleration of non-monoatomic analytes. In various embodiments, the systems and methods of the invention have many applications or potential applications, including improving analyte detection or the efficiency thereof, for example, in the contexts of mass spectrometry, genomics and/or proteomics; structure determination of large molecules, including polymers and large biomolecules; and the analysis of surfaces and samples, including samples used in medical diagnostics and biomedical research, by probing with accelerated particles and/or molecular ions.

In some embodiments, the present invention provides an apparatus comprising a source of ionized analyte; a pulsed-voltage acceleration subsystem; at least one power supply and at least one function generator connected to the pulsed-voltage acceleration subsystem; and an ion detector; wherein the apparatus is configured to accelerate the analyte.

In certain embodiments, the invention provides a method of accelerating an analyte, the method comprising providing a non-monoatomic analyte that is ionic and in the gas phase, and subjecting the analyte to a series of high-voltage pulses.

In various embodiments, the invention provides a method of increasing the efficiency with which a non-monoatomic, ionic, gas phase analyte is detected, comprising subjecting the analyte to a series of pulsed high-voltage potential differences, through which the analyte is accelerated, prior to detection.

The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The drawings, which are incorporated in and constitute a part of this specification, illustrate embodiments of the principles of the present invention and together with the description, serve to explain the principles of the invention.

DETAILED DESCRIPTION OF THE EMBODIMENTS

Figure 1:
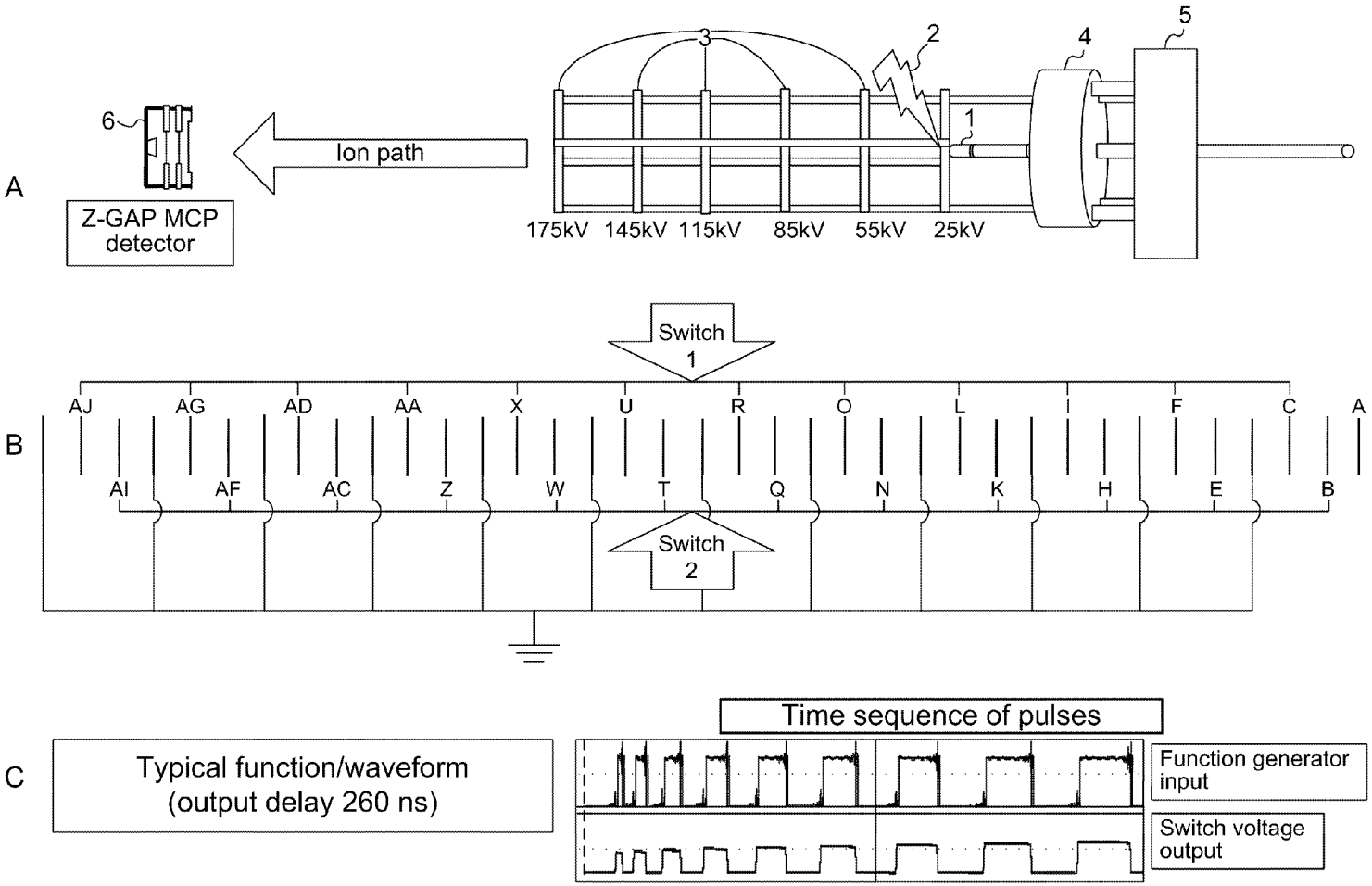
FIG. 1A. Schematic of an exemplary molecular ion accelerator. A desorption/ionization plate 1 is shown at right with excitation energy (e.g., a laser) represented symbolically as a lightning bolt 2. The pulsed-voltage acceleration subsystem, comprising electrodes, is represented by the series of vertical bars 3; the cumulative voltage imparted is shown below each, with the sample plate giving 25 kV and each subsequent plate contributing 30 kV. The accelerated ion then travels toward a Z-GAP microchannel plate (MCP) detector 6. Also shown is a holding block 4 used to connect the electrodes to a flange 5.
FIG. 1B. Illustration of connectivity between electrodes and function generator/power supply sets. A series of 37 electrodes is shown, labeled alphabetically; for clarity, not all are labeled. Plate A is the sample plate, which is connected to a dedicated independent DC power supply (not shown). One power supply and function generator set, which produces switch voltage 1 (represented by the Switch 1 arrow) is connected to electrodes C, F, I, etc., up to AJ. A second power supply and function generator set, which produces switch voltage 2 (represented by the Switch 2 arrow) is connected to electrodes B, E, H, etc., up to AI). The unlabeled plates are connected to ground voltage.
FIG. 1C. Function generator waveform input and power supply output. Shown is a representative plot of input and output voltage versus time, with earlier pulses further to the right. The pulses are those generated by one power supply and function generator set, e.g., switch 2 of FIG. 1B.

The term "analyte" includes molecular ions, non-monoatomic species, macromolecules, including but not limited to polynucleotides, polypeptides, and polysaccharides, macromolecular complexes, chromosomes, cells, including but not limited to cancerous cells, bacteria, viruses, spores, organelles, including but not limited to ribosomes, mitochondria, chloroplasts, and synaptosomes, pollen grains, polymers, dendrimers, particles, microparticles, nanoparticles, aerosol particles, fine particulate objects, other objects, or mixtures thereof being subjected to acceleration.

A "mass analyzer" is a component or subsystem that is used for determination of analyte mass to charge ratio.

A. Apparatus

1. Analyte Introduction

An apparatus according to the invention can comprise an ion source that, prior to acceleration, provides the analyte in the gas phase in an ionized state. In some embodiments, the ion source can be configured to vaporize an analyte that is initially provided in solid or liquid form. The analyte can be initially charged, such as in the case of, for example, polyatomic ions. In some embodiments, the ion source is configured to ionize an analyte that is initially in a neutrally charged state. The apparatus can be configured to vaporize and/or ionize an analyte by, for example, laser-induced acoustic desorption, matrix-assisted laser desorption-ionization, electrospray ionization, surface-enhanced laser desorption-ionization, desorption-ionization on silicon, desorption-electrospray ionization, plasma desorption, field desorption, electron ionization, chemical ionization, field ionization, fast atom bombardment, ion attachment ionization, thermospray, atmospheric pressure ionization, atmospheric pressure photoionization, atmospheric pressure chemical ionization, supersonic spray ionization, or direct analysis in real time. The apparatus can also be configured to ionize any neutral molecule in a vacuum or in the gas phase by photoionization, including single photon and multiphoton ionization (See FIG. 2B). Mention may also be made of ion sources that additionally sort or fractionate analyte in addition to vaporization and/or ionization, such as, for example, ion sources wherein the analyte is obtained from gas or liquid chromatographs. Additional modes of vaporization and ionization are also included within this invention. See, e.g., E. de Hoffmann and V. Stroobant, *Mass Spectrometry: Principles and Applications* (3rd Ed., John Wiley & Sons Inc., 2007).

Matrix-Assisted Laser Desorption Ionization (MALDI) can be used by configuring the apparatus with a substrate on which the analyte can be mounted, with an underlying matrix comprising a light-absorbing chemical, for example, 2,5-dihydroxy-benzoic acid, 3,5-dimethoxy-4-hydroxycinnamic acid, 4-hydroxy-3-methoxycinnamic acid, α-cyano-4-hydroxycinnamic acid, picolinic acid, 3-hydroxy-picolinic acid, or the like. See, e.g., M. Karas, F. Hillenkamp, *Anal Chem,* 60:2299-301 (1988). Laser irradiation of the matrix can be used to desorb the analyte from the substrate.

The apparatus can comprise a flange and a holding block. The flange and holding block can be constructed from a strong material with a low vapor pressure, for example, less than 0.1 mTorr at room temperature. In some embodiments, the flange is an 8" flange and the holding block is composed of a plastic such as, for example, polyethylene or poly(methyl methacrylate) (e.g., LUCITE), or a metal such as, for example, stainless steel. In some embodiments, the holding block is composed of an electrical insulator. The flange and holding block may or may not be composed of the same material.

2. Pulsed-Voltage Acceleration Subsystem

The apparatus comprises components for accelerating the analyte. When techniques are employed that initially accelerate the analyte through a potential difference such as, for example, MALDI, the apparatus is configured to subject the analyte to additional acceleration. The acceleration effected by this subsystem can improve the efficiency of analyte detection. The pulsed-voltage acceleration subsystem operates at a pressure below atmospheric pressure. In some embodiments, it operates in a vacuum. In some embodiments, a flange is used to tightly close off a vacuum chamber containing components of the apparatus such as the pulsed-voltage acceleration subsystem and any other component that operates in vacuum.

Acceleration of the analyte is effected by a pulsed-voltage acceleration subsystem, which is connected to at least one set of power supplies and function generators. This subsystem comprises a series of electrodes. The electrodes can have the geometry of plates, cylinders, boxes, or another geometry that allows the electrodes to generate a potential difference that accelerates the analyte in the desired direction. In the case of electrode geometries such as plates, the electrodes contain openings through which the analyte can pass. The use of electrodes with plate geometry can be useful in minimizing the divergence of a beam of accelerated analyte. The use of electrodes with cylindrical geometry can provide increased convenience in embodiments wherein the pulsed-voltage acceleration subsystem of the apparatus serves as an independent time-of-flight mass analyzer. The series of electrodes can comprise a number of electrodes ranging from 2 to 1,000 or more, for example, 2, 3, 4, 5, 6, 7, 10, 16, 18, 24, 30, 40, 50, 60, 70, 80, 90, or 100, 200, 500, or 1,000. In some embodiments, the electrodes are less than 0.5 inches apart. The electrodes are spaced far enough apart to avoid causing breakdown or arcing.

In some embodiments, the apparatus comprises 2, 3, 4, 5, or more sets of power supplies and function generators. If multiple sets of power supplies and function generators are present, they can be connected to the electrodes so that adjacent plates are connected to different functional generators and power supplies; that is, if there are, for example, three sets of power supplies and function generators, a first electrode can be connected to a first generator/supply, a second electrode to a second generator/supply, and the third electrode to a third generator/supply, and then the fourth, fifth, and sixth plates can be connected to the first, second, and third generators/supplies, respectively, and so on.

In some embodiments, the apparatus comprises an electrostatic lens. The lens may be, for example, an Einzel lens. This lens can be used to focus analyte and may be tuned according to the kinetic energy of the analyte. The structure and use of electrostatic lenses is known in the art and details may be found, for example, in E. Harting and F. H. Read, *Electrostatic Lenses*, Elsevier, N.Y., 1976.

The apparatus applies a pulsed voltage between electrodes to accelerate the analyte. This voltage can range from 5 to 100 kV, for example, 5, 10, 15, 20, 25, 30, 35, 40, 50, 60, 70, 80, 90, or 100 kV.

In some embodiments, the apparatus can accelerate an analyte to a kinetic energy of at least 50, 75, 100, 150, 200, 300, 400, 500, 600, 700, 800, or 900 keV, or 1, 1.5, 2, 2.5, or 3 MeV. In some embodiments, the analyte accelerated by the apparatus can have a molecular weight of at least 200 or 500 Da; 1, 2, 5, 10, 20, 50, 100, 200, 300, 400, or 500 kDa; 1, 2, 3, 4, 5, 10, 20, 30, 40, 50, 100, or 200 MDa; or 1 GDa. In some embodiments, the analyte accelerated by the apparatus comprises a virus, cell, nanoparticle, or microparticle with a mass greater than or equal to $1\times10^{15}$ Da or $1\times10^{16}$ Da.

3. Mass Analyzer

The apparatus can comprise a mass analyzer. In some embodiments, the pulsed-voltage acceleration subsystem itself is a time-of-flight mass analyzer, wherein the mass to charge ratio (m/z) is determined based on the duration of the passage of the analyte through its flight path, during and optionally after acceleration. In some embodiments, the apparatus comprises a mass analyzer distinct from the pulsed-voltage acceleration subsystem. The distinct mass analyzer can be positioned before the pulsed-voltage acceleration subsystem, so that the analyte is sorted or selected according to its mass to charge ratio prior to acceleration. In these embodiments, the analyte is conveyed from the mass analyzer to the pulsed-voltage acceleration subsystem, for example, by ejection from the mass analyzer.

Figure 10:
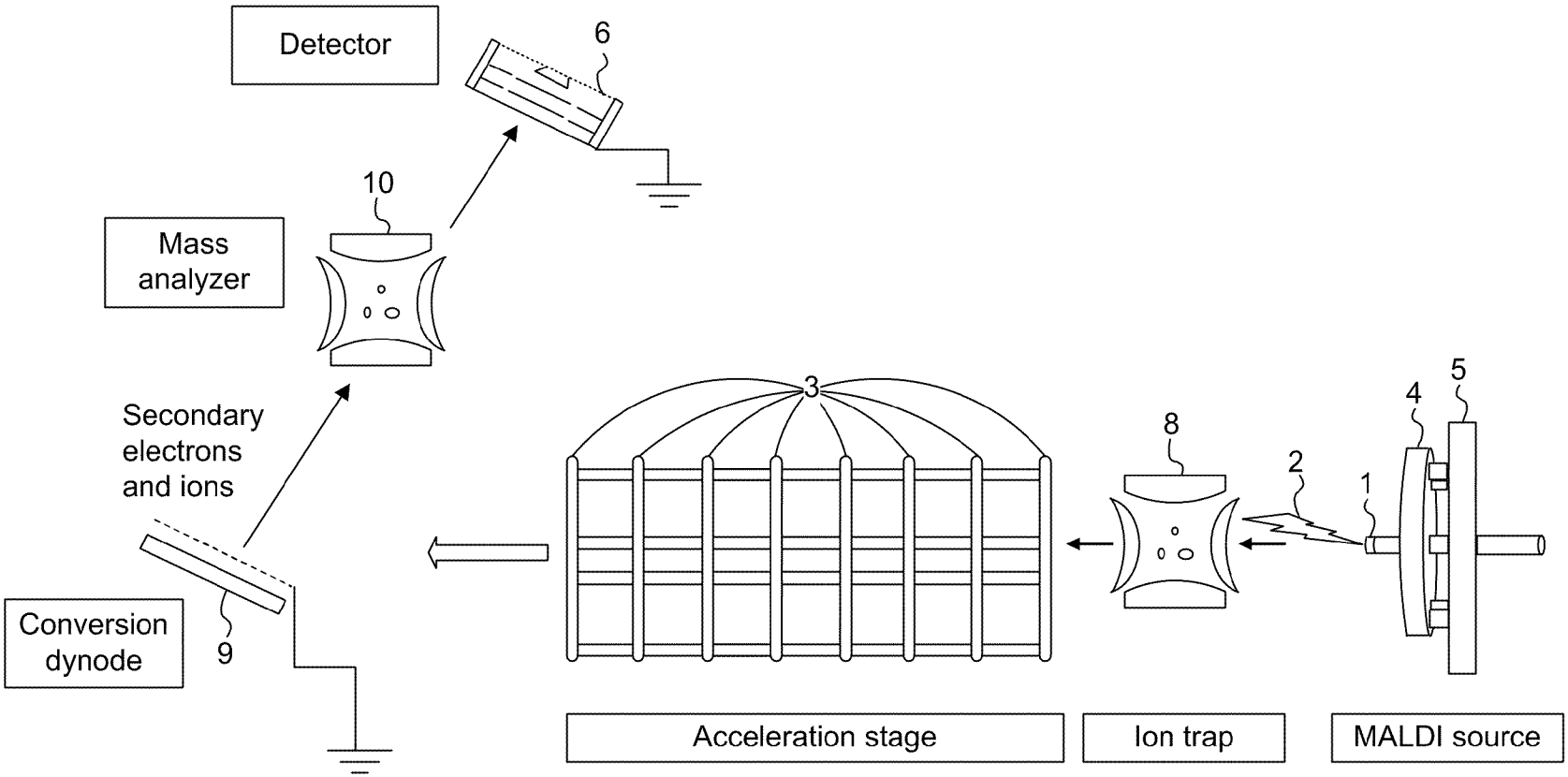
FIG. 10. Tandem MS-Accelerator-MS apparatus. An apparatus comprising a mass analyzer 10 positioned to receive secondary ions from a conversion dynode 9 is illustrated schematically. Secondary ions are sorted according to their mass to charge ratio by the mass analyzer 10 and then are detected by a detector 6. Additional components are as in FIG. 9.

In some embodiments, the apparatus comprises a distinct mass analyzer positioned after the pulsed-voltage acceleration subsystem and the conversion dynode. In such embodiments, the apparatus can sort or select a fragment or fragments of the analyte according to mass to charge ratio after acceleration and collision with the conversion dynode (see FIG. 10). The apparatus can be configured to effect collision-induced dissociation of the analyte in the pulsed-voltage acceleration subsystem, so that analyte fragments are subsequently introduced into the mass analyzer. Many types of mass analyzer can be included in the apparatus. The mass analyzer may use an electromagnetic field to sort analytes in space or time according to their mass to charge ratio.

a) Ion Trap-Based Analyzer

The apparatus can comprise an ion trap. This type of mass analyzer can subject the analyte to an electric field oscillating at a radio frequency (RF) and the electrodes of the trap can additionally have a DC bias, for example, of around 2000 V.

Figure 9:
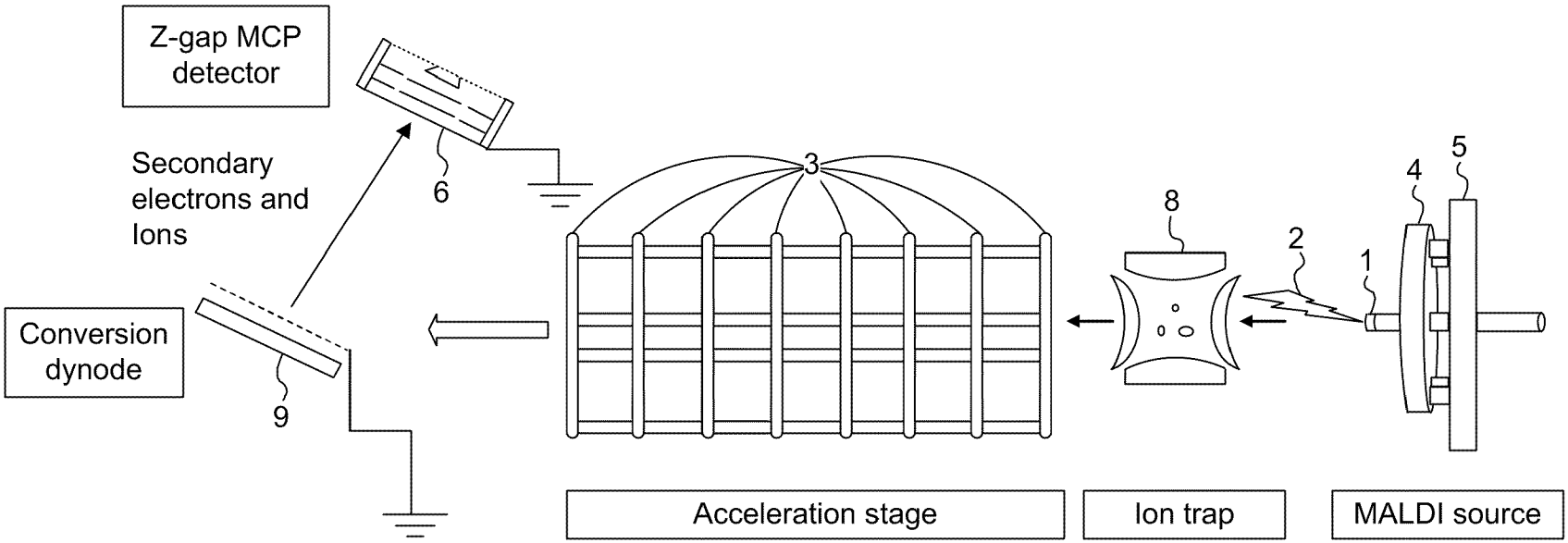
FIG. 9. Ion-trap ion accelerating mass spectrometer. Shown is a schematic diagram for an exemplary apparatus comprising, inter alia, an ion trap mass analyzer 8, a sample plate 1, a pulsed-voltage acceleration subsystem comprising electrodes 3, and a detector comprising a conversion dynode 9 and a Z-gap microchannel plate detector 6; additional components are as in FIG. 1A. Operation of this apparatus can comprise ionizing analyte by MALDI, introducing analyte into the ion trap mass analyzer, ejecting analyte from the ion trap according to its mass to charge ratio, accelerating the analyte through the pulsed voltage acceleration subsystem, contacting the conversion dynode with the analyte, producing secondary electrons and/or ions, and detecting the secondary electrons and/or ions with the microchannel plate.

The ion trap can be a three-dimensional quadrupole ion trap, also known as a Paul Ion Trap, which can have end cap electrodes and a ring electrode. In some embodiments, the end cap electrodes can be hyperbolic. In some embodiments, the end cap electrodes can be ellipsoid. Holes can be drilled in the end cap electrodes to allow observation of light scattering and through which analyte can be ejected. The frequency of oscillation can be scanned to eject an analyte from the trap according to its mass to charge ratio. FIG. 9 illustrates an apparatus configured with a quadrupole ion trap.

The ion trap can be a linear ion trap (LIT), also known as a two dimensional ion trap. In some embodiments, the linear ion trap can have four rod electrodes. The rod electrodes can cause oscillation of analyte in the trap through application of an RF potential. An additional DC voltage can be applied to the end parts of the rod electrodes to repel analyte toward the middle of the trap. In certain embodiments, the linear ion trap can have end electrodes placed near the ends of the rod electrodes, and these end electrodes can be subject to a DC voltage to repel analyte toward the middle of the trap. Analyte can be ejected from the linear ion trap. In some embodiments, ejection can be accomplished axially using fringe field effects generated, for example, by an additional electrode near the trap. Ejection can also be accomplished radially through slots cut in rod electrodes. The LIT can be coupled with more than one detector so as to permit detection of analyte ejected axially and radially.

b) Other Mass Analyzers

Additional mass analyzers that can be adapted for use with the invention include, without limitation, quadrupole, magnetic sector, orbitrap, time-of-flight, electrostatic field, dual sector, and ion cyclotron resonance mass analyzers. See, e.g., E. de Hoffman and V. Stroobant, *Mass Spectrometry: Principles and Applications* (3$^{rd}$ Ed., John Wiley & Sons Inc., 2007). Other types of mass analyzers are also included in this invention.

4. Detector

The apparatus can comprise a detector. In some embodiments, the detector is located at the end of the flight path followed by analyte as it is accelerated by the pulsed-voltage acceleration subsystem, wherein the flight path can comprise a field-free region in addition to the region in which the pulsed voltages are applied. In some embodiments, the detector is located adjacent to a mass analyzer so that it detects particles ejected by the mass analyzer. In some embodiments, the detector is integrated with the mass analyzer, as is typical in mass analyzers that detect analyte inductively, such as, for example, ion cyclotron resonance or orbitrap mass analyzers.

The detector can comprise a secondary electron amplification device such as a microchannel plate (MCP), a microsphere plate, an electromultiplier, or a channeltron. The detector can comprise a conversion dynode, which can be discrete or continuous. In some embodiments, the detector can comprise an energy detector device such as a superconducting cryogenic detector. In some embodiments, the detector operates by producing secondary ions, and/or by secondary electron ejection and amplification detection. Mention can also be made of other types of detectors, including, without limitation, charge detectors such as Faraday cups or plates and induction charge detectors, electro-optical ion detectors, and photographic plates.

5. Beam Emission

In some embodiments, the apparatus is configured to emit accelerated analyte. The accelerated analyte can form a beam of particles and/or ions. In these embodiments, the analyte is accelerated out of the apparatus, and can be used in the treatment or analysis of, for example, compositions, surfaces, articles, samples, or patients. Possible types of target materials for treatment and/or analysis in these embodiments include, without limitation, semiconductors, tissue samples, metals, cells, and alloys.

B. Methods

The invention also relates to methods for accelerating an analyte. In some embodiments, the methods further relate to improving the efficiency of detection of the analyte, effecting collision-induced dissociation of the analyte, performing mass spectrometry on the analyte, or producing a beam comprising accelerated analyte.

1. Providing Analyte

The methods can comprise providing analyte that is ionic and in the gas phase. This can be accomplished in a variety of ways. In some embodiments, the analyte can be provided in gaseous form by an upstream step, such as, for example, gas chromatography. In some embodiments, the analyte comprises a charged species such as, for example, a polyatomic ion. In some embodiments, the analyte is ionized and/or vaporized by laser-induced acoustic desorption, matrix-assisted laser desorption-ionization, electrospray ionization, surface-enhanced laser desorption-ionization, desorption-ionization on silicon, desorption-electrospray ionization, plasma desorption, field desorption, electron ionization, chemical ionization, field ionization, fast atom bombardment, ion attachment ionization, thermospray, atmospheric pressure ionization, atmospheric pressure photoionization, atmospheric pressure chemical ionization, supersonic spray ionization, or direct analysis in real time. Additional modes of vaporization and ionization are also included within this invention. See, e.g., E. de Hoffman and V. Stroobant, *Mass Spectrometry: Principles and Applications* (3rd Ed., John Wiley & Sons Inc., 2007).

2. Subjecting the Analyte to a Series of High Voltage Pulses

The methods comprise subjecting the analyte to a series of high voltage pulses. Such pulses can be generated, for example, by generating a potential difference between two electrodes, or between an electrode and something that is at ground potential. The pulses result in acceleration of the analyte. The series of pulses can comprise a number of pulses ranging from 2 to 1000 or more, for example, 2, 3, 4, 5, 6, 7, 10, 16, 18, 24, 30, 40, 50, 60, 70, 80, 90, 100, 200, 300, 400, 500, 600, 700, 800, 900, or 1000.

The pulsed voltage can range from 5 to 100 kV, for example, 5, 10, 15, 20, 25, 30, 35, 40, 50, 60, 70, 80, 90, or 100 kV. In some embodiments, the methods comprise accelerating an analyte to a kinetic energy of at least 50, 75, 100, 150, 200, 300, 400, 500, 600, 700, 800, or 900 keV, or 1, 1.5, 2, 2.5, 3, 4, 5, 10, 20, 30, 40, 50, or 100 MeV.

3. Performing Mass Spectrometry

In some embodiments, the methods comprise performing mass spectrometry on the analyte or fragments thereof. Time-of-flight mass spectrometry can be performed by monitoring the duration of analyte movement through the area where it is subjected to high-voltage pulses, and optionally through a field-free zone, within which the analyte continues to move away from the pulsed voltage acceleration subsystem without substantial change in its kinetic energy. Mass spectrometry can also be performed by using a mass analyzer in conjunction with accelerating the analyte by subjecting it to high voltage pulses. Many types of mass analyzer can be used, as discussed in section A.3 above.

4. Effecting Collision Induced Dissociation

In some embodiments, the methods comprise effecting collision induced dissociation (CID). CID can be accomplished by accelerating the analyte, providing at least one additional particle or a solid surface, and contacting the at least one additional particle or a solid surface with the accelerated analyte. Upon contact, CID occurs, and the resulting analyte fragments can be analyzed, for example, mass spectrometrically. The at least one additional particle can be provided in the form of a gas that is present in an area where the analyte can collide with the molecules or atoms of the gas. The gas can be, for example, helium, neon, argon, or nitrogen. The gas pressure can range from $10^{-7}$~$10^{1}$ Torr.

5. Detecting Accelerated Analyte

In some embodiments, the analyte is detected following acceleration. Detectors that can be used are described in section A.4 above. The methods relate to improving the efficiency of detection by accelerating the analyte. Analytes with higher kinetic energy can be detected more efficiently by some types of detector, including, for example, detectors comprising a conversion dynode and/or a secondary electron amplification device, such as an microchannel plate, an electromultiplier, or a channeltron. These ions can also be detected by producing secondary ions which are subsequently detected by a secondary electron ejection and amplification detector. Without wishing to be bound by any particular theory, it is thought that contacting the above types of detectors and potentially others that involve signal amplification with accelerated analyte results in more secondary ions and/or electrons being emitted from the site of contact due to the greater energy of the collision.

Detection efficiency may also be improved by accelerating analyte for detectors comprising an energy detector device, such as, for example, a superconducting cryogenic detector.

In some embodiments, the invention relates to improving the sensitivity of detection by a mass spectrometer by accelerating the analyte prior to detection. The step of sorting or selecting analyte according to its mass to charge ratio can occur prior to or at the same time as the step of accelerating the analyte.

6. Contacting a Surface with Accelerated Analyte

In some embodiments, the methods relate to contacting a surface with accelerated analyte. These methods can further comprise detecting interactions between the analyte and the surface, or analyzing materials (e.g., molecules, ions, or particles) that are ejected from the surface due to interaction with the accelerated analyte. Interactions can be detected in any number of ways, including, without limitation, optically, vibrationally, thermally, or by structural analysis (e.g., testing of rigidity, hardness, or other mechanical properties) of the surface while or after it is contacted by the accelerated analyte.

EXAMPLES

Example 1

Molecular Ion Accelerator

Figure 2A:
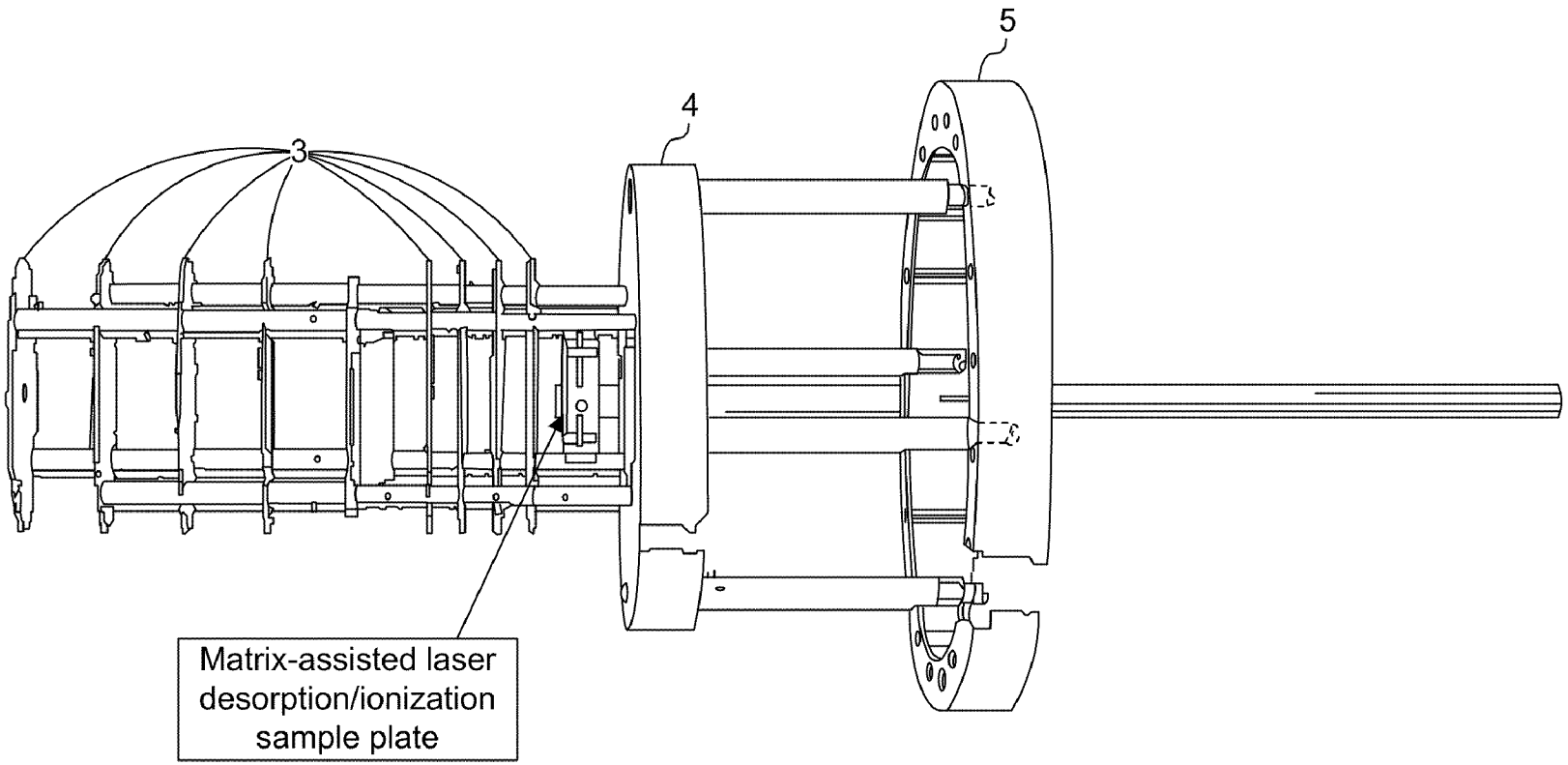
FIG. 2A. Physical assembly of the sample plate, holding block, flange, and a series of pulsed voltage acceleration plates 3 of a molecular ion accelerator configured for MALDI.
Figure 2B:
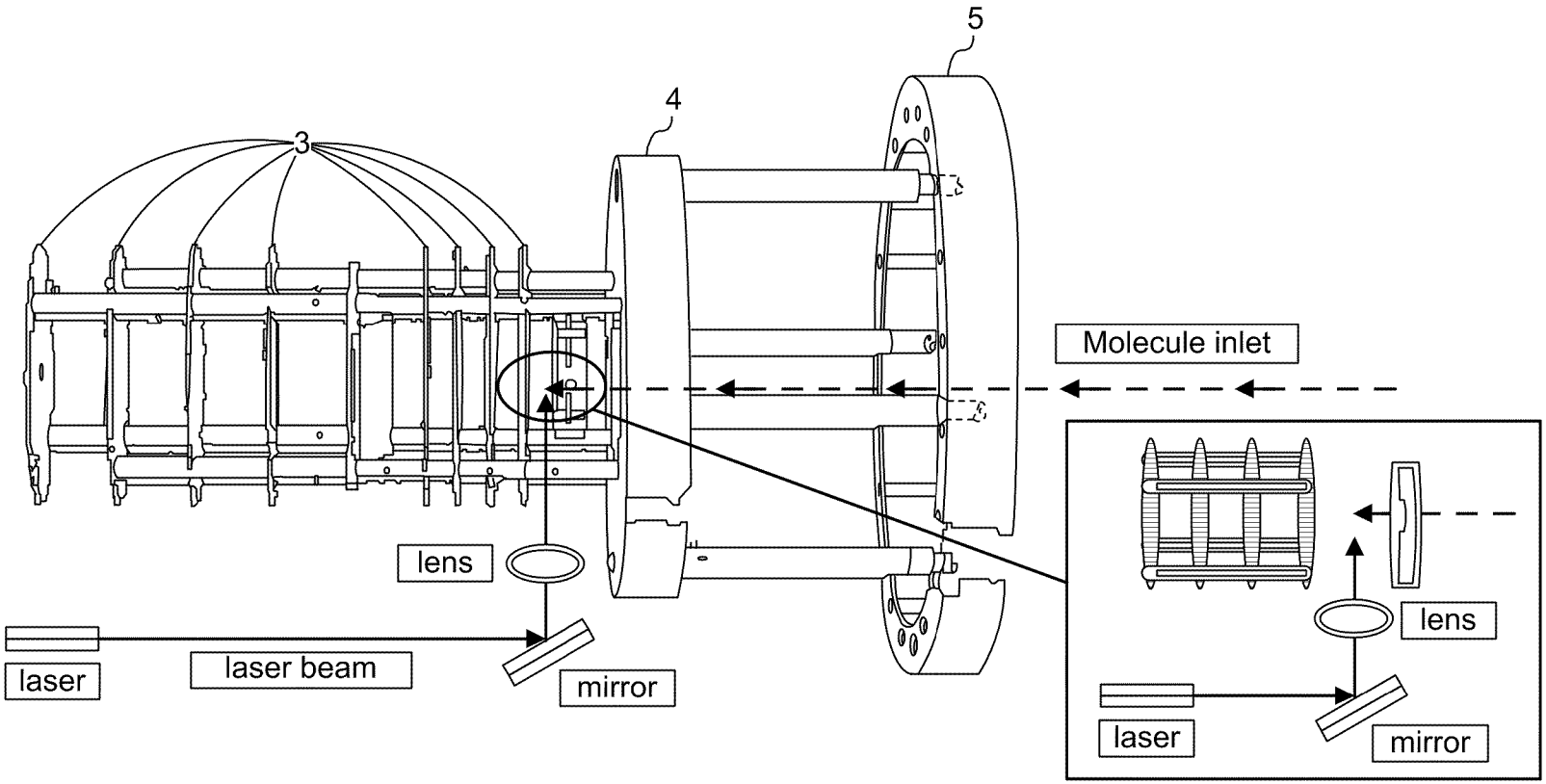
FIG. 2B. Physical assembly of holding block, flange, and a series of pulsed voltage acceleration plates 3 of a molecular ion accelerator configured for photoionization of analyte in the gas phase or suspended in vacuum. A laser, mirror, and lens for irradiating analyte are represented schematically, and the inset shows a schematic representation of the immediate vicinity where photoionization occurs.
Figure 2C:
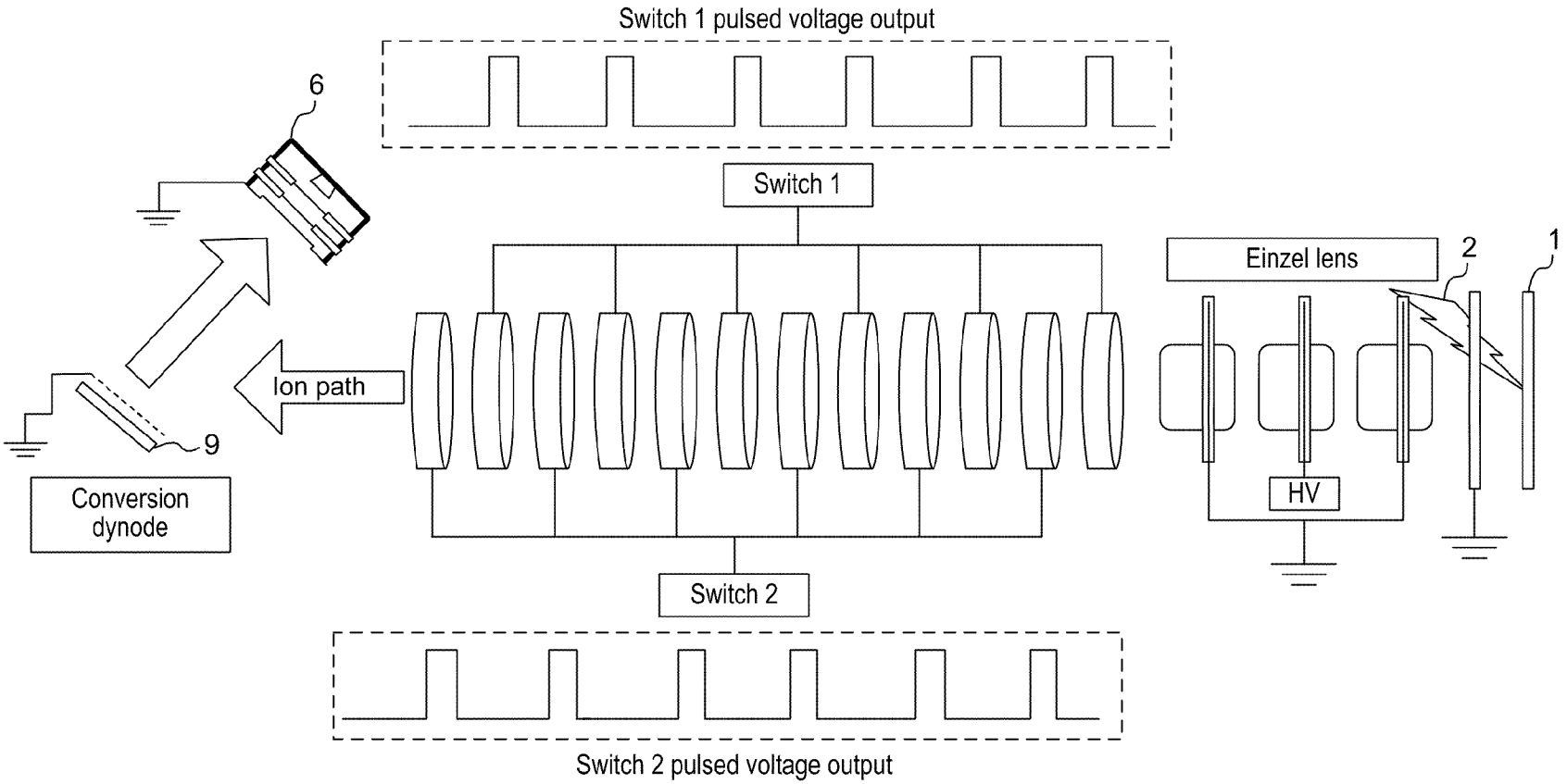
FIG. 2C. Schematic representation of a molecular ion accelerator configured with cylindrical electrodes and an Einzel lens. Analyte is ionized at a sample plate 1 by an ionization source 2 (e.g., a laser as in MALDI). Analyte then passes through the Einzel lens, where the analyte ions are focused; the Einzel lens focusing voltage may be tuned according to the analyte kinetic energy. Analyte is then accelerated through the cylindrical electrodes, which are connected to switch voltage 1 or switch voltage 2 in an alternating manner as indicated. The accelerated analyte then contacts a conversion dynode 9, and resulting secondary electrons and/or ions are detected by a detector 6.

The schematic of apparatuses that were constructed in accordance with an embodiment of the invention is shown in FIGS. 1 and 2. In each case, the apparatus was configured for MALDI and contained a series of acceleration electrodes. Sets of function generators and power supplies were connected to the plates so that adjacent plates were connected to different function generators and power supplies, as illustrated in FIGS. 1 and 2. The plates contained central holes through which desorbed analyte could pass. There was a total of 37 plates in the apparatus that was constructed. Beyond the last plate was a Z-gap multichannel plate (MCP) detector.

Example 2

Acceleration of BSA

A sample of bovine serum albumin (BSA) was prepared for MALDI as follows. 1 μL of BSA dissolved at 100 pmol/μL in double distilled water and 9 μL of 0.1M sinapinic acid matrix solution dissolved in acetonitrile and double distilled water mixed in a 1:1 volume ratio were mixed together and deposited onto the sample plate. A laser beam was used to vaporize BSA ions into the gas phase. A voltage of approximately 20 kV was applied to the sample plate to accelerate the desorbed ions toward the series of acceleration plates. In a control experiment, no further acceleration was performed and the ions continued toward the ionization plate (FIG. 3A).

In another experiment, begun as above, after the desorbed ions passed the first plate, a pulsed voltage of approximately 20 kV was applied between the first plate and second plate to give further acceleration so that when the desorbed ions reached the second plate, the ion energy was approximately 40 keV. The ions then continued until they reached the detector. This result is shown in FIG. 3B.

In still another experiment, begun as above, after the desorbed ions passed the first plate, a pulsed voltage of approximately 35 kV was applied between the first plate and second plate to give further acceleration so that when the desorbed ions reached the second plate, the ion energy was approximately 55 keV. The ions then continued until they reached the detector. This result is shown in FIG. 3C.

Figure 3:
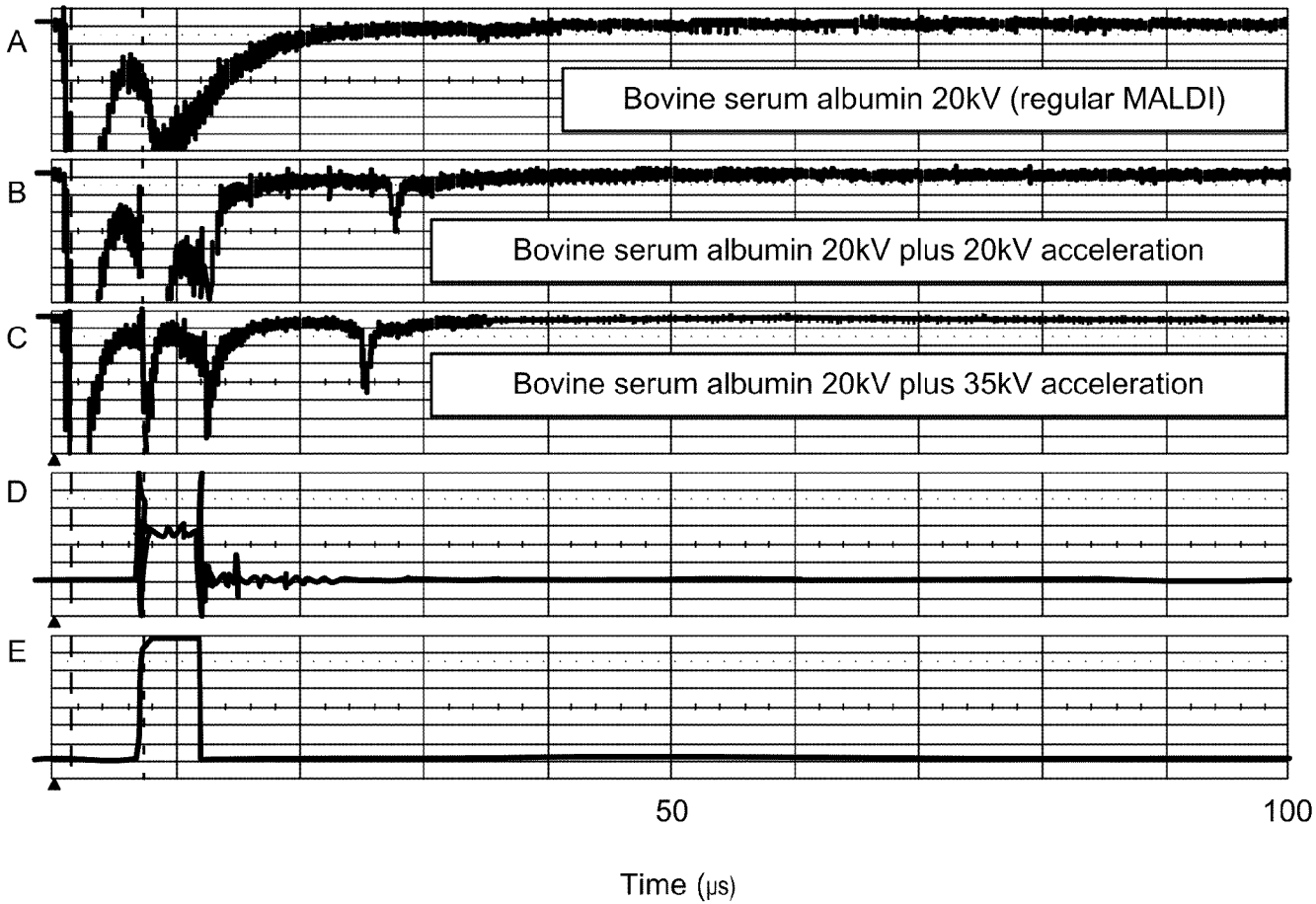
FIG. 3. Effect of acceleration on efficiency of detection of BSA. Panels A-C show detection results of experiments where BSA was subjected to conventional MALDI (panel A) or differing degrees of acceleration (panels B-C). The vertical scale of Panels A-C is 2 mV per solid gridline interval (all subsequent vertical scales in FIGS. 3, 4, and 7 are listed per solid gridline interval). Analyte was detected at approximately 35 μs, 28 μs, and 25 μs in Panels A, B, and C respectively. Panels D and E represent function generator waveform input and power supply output, respectively. The vertical scale of Panel D is 5 mV, and that of Panel E is 1 V.

FIGS. 3D and 3E show the function generator and high voltage power supply outputs, respectively, for single stage acceleration in the accelerating assembly.

Without additional acceleration, the detected signal from impact of the BSA ions on the detector was less than 2 mV (FIG. 3A). Signal strength increased to approximately 5 mV (FIG. 3B) or 7 mV (FIG. 3C) when the analyte was subjected to additional acceleration.

Example 3

Acceleration of Lactoferrin

A sample of lactoferrin prepared for MALDI was placed on the tip of the sample plate. A laser beam was used to vaporize lactoferrin ions into the gas phase. A voltage of approximately 25 kV was applied to the sample plate to accelerate the desorbed ions toward the series of acceleration plates.

Figure 4:
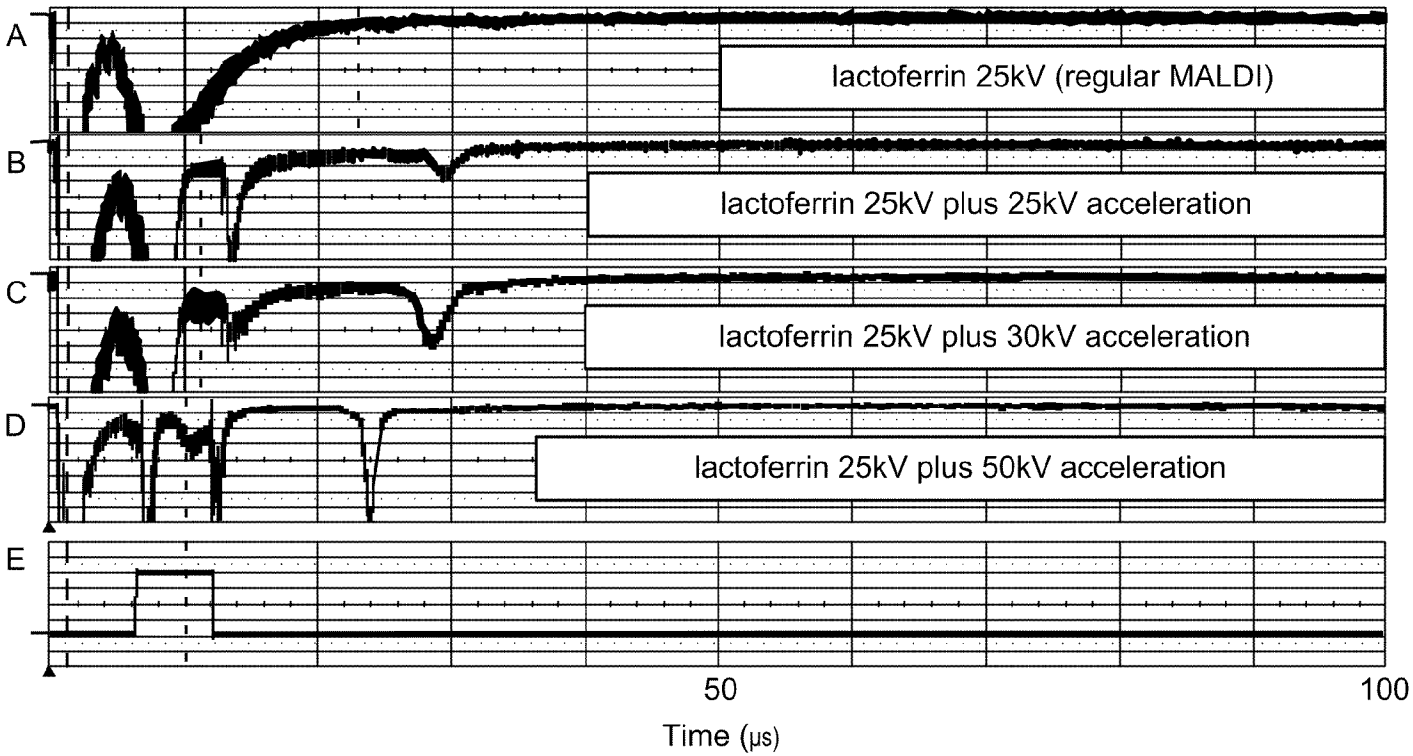
FIG. 4. Effect of acceleration on efficiency of detection of lactoferrin. Panels A-D show detection results of experiments where lactoferrin was subjected to conventional MALDI (panel A) or differing degrees of acceleration (panels B-D). The vertical scale of Panels A-D is 2 mV. Analyte was detected at approximately 33 μs, 29 μs, 28 μs, and 24 μs in Panels A, B, C, and D respectively. Panel E represents power supply output. The vertical scale of Panel E is 1 V.

In a control experiment, no further acceleration was performed and the ions continued toward the ionization plate (FIG. 4A).

In another experiment, begun as above, after the desorbed ions passed the first plate, a pulsed voltage of approximately 25 kV was applied between the first plate and second plate to give further acceleration so that when the desorbed ions reached the second plate, the ion energy was approximately 50 keV. The ions then continued until they reached the detector. This result is shown in FIG. 4B.

In still another experiment, begun as above, after the desorbed ions passed the first plate, a pulsed voltage of approximately 30 kV was applied between the first plate and second plate to give further acceleration so that when the desorbed ions reached the second plate, the ion energy was approximately 55 keV. The ions then continued until they reached the detector. This result is shown in FIG. 4C.

In still another experiment, begun as above, after the desorbed ions passed the first plate, a pulsed voltage of approximately 25 kV was applied between the first plate and second plate, and when the ions passed the second plate, a pulsed voltage of approximately 25 kV was applied between the second and third plate to give further acceleration so that when the desorbed ions reached the third plate, the ion energy was approximately 75 keV. The ions then continued until they reached the detector. This result is shown in FIG. 4D.

FIG. 4E shows the high voltage power supply output for single stage acceleration in the accelerating assembly.

Without additional acceleration, the detected signal from impact of the lactoferrin ions on the detector was less than 2 mV (FIG. 4A). Signal strength increased noticeably as the degree of acceleration increased, to approximately 3 mV, 9 mV, and 12 mV in FIGS. 4B-D, respectively.

Example 4

Acceleration of IgG

Figure 5A:
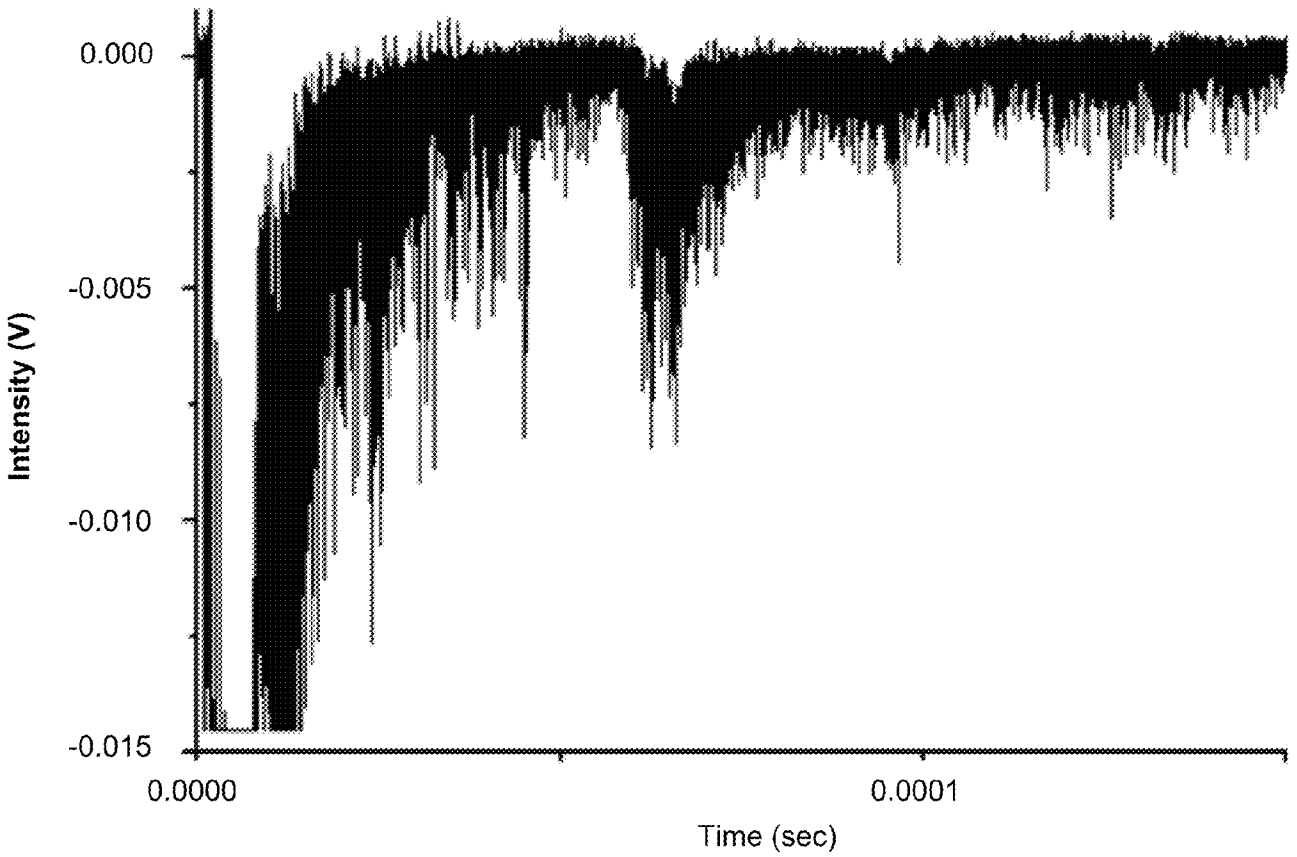
FIG. 5. Detection of IgG at different levels of acceleration. Detection results are shown for IgG accelerated to four different degrees in Panels A-D. Detection occurred between approximately 0.00005 and 0.00007 sec in each of Panels A-D.
Figure 5B:
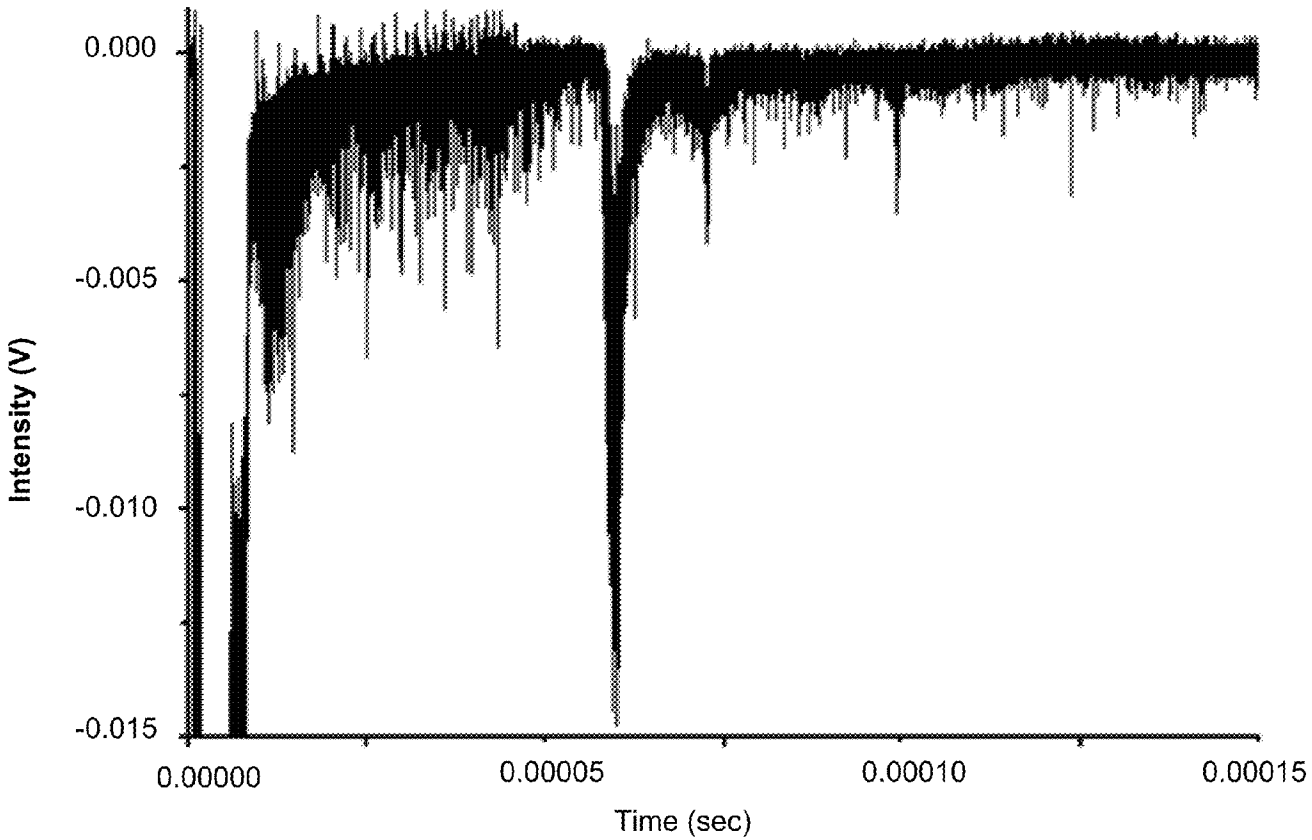
Figure 5C:
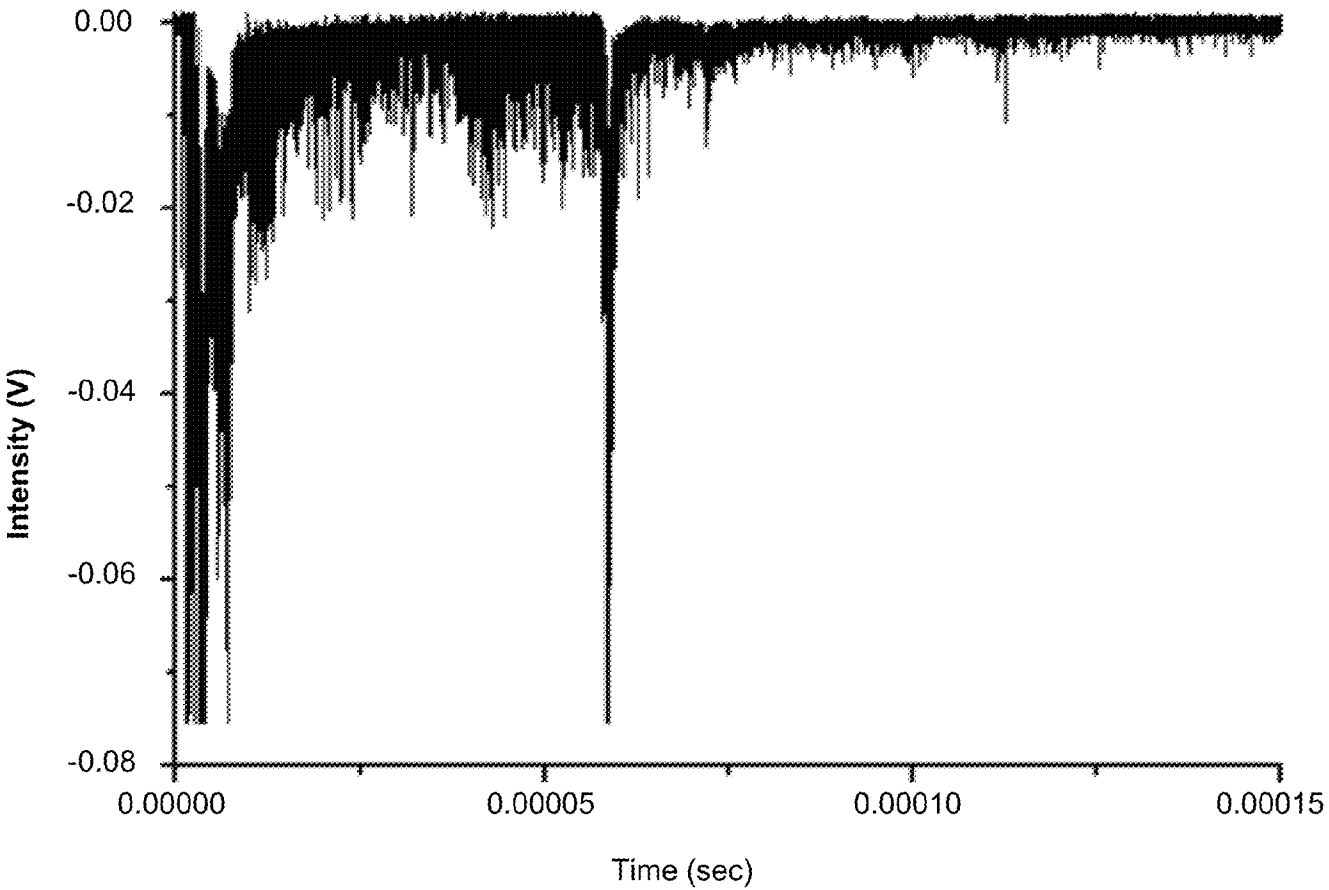
Figure 5D:
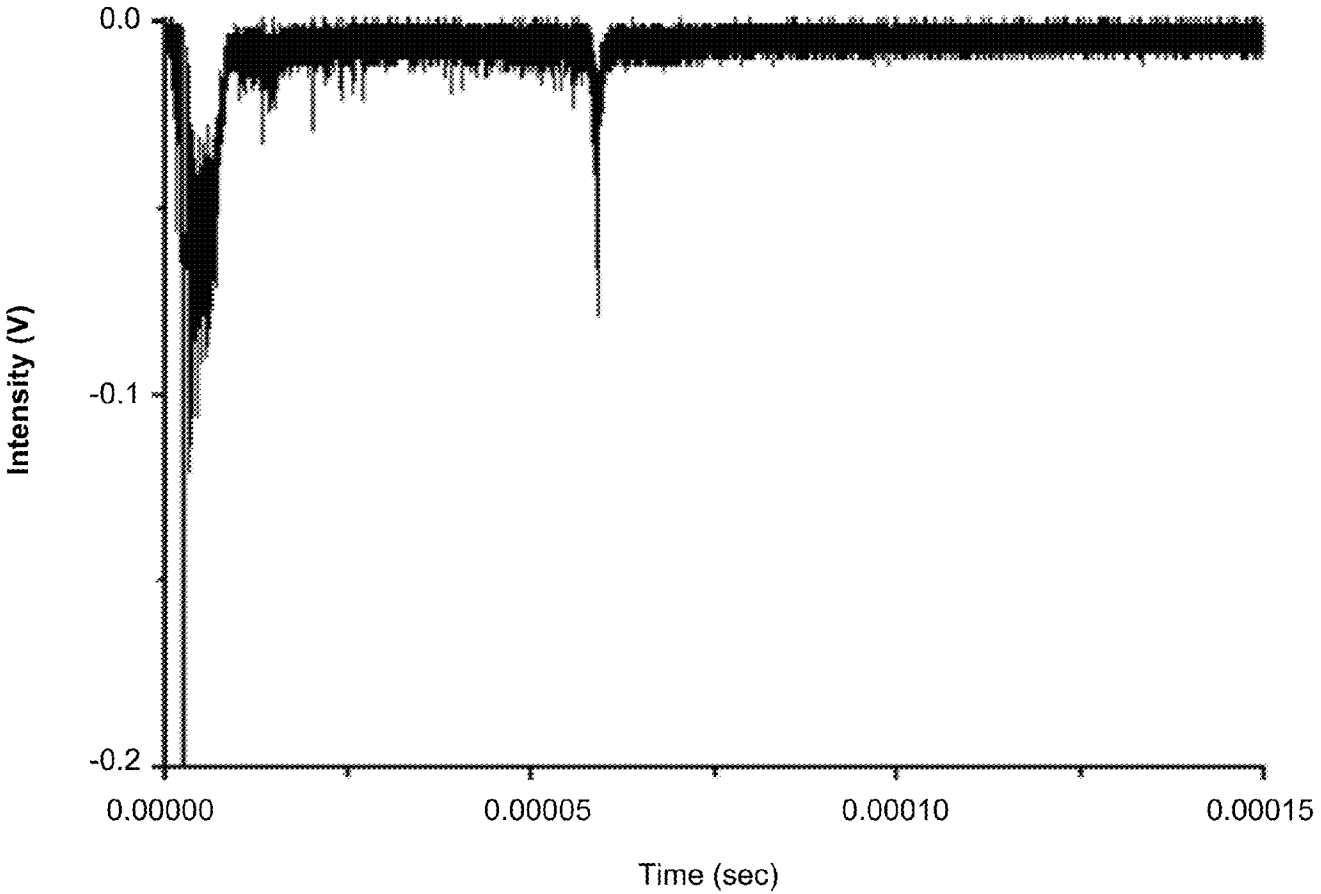

Immunoglobulin G (IgG) was vaporized by MALDI as in Example 3. In addition to the 25 kV voltage at the sample plate, the analyte was subjected to a series of pulsed voltages between individual acceleration plates. In different experiments, the series was either 10 stages at 30 kV each (FIG. 5A), 16 stages at 35 kV each (FIG. 5B), 24 stages at 35 kV each (FIG. 5C), or 24 stages at 40 kV each (FIG. 5D). The approximate kinetic energies of the analyte after acceleration in each experiment were 325 keV, 585 keV, 865 keV, and 985 keV, respectively, and the signal intensities were approximately 8 mV, 15 mV, 75 mV and 80 mV. Thus, the detected signal intensity increased according to the degree of acceleration.

Example 5

Acceleration of Fibrinogen

Figure 6A:
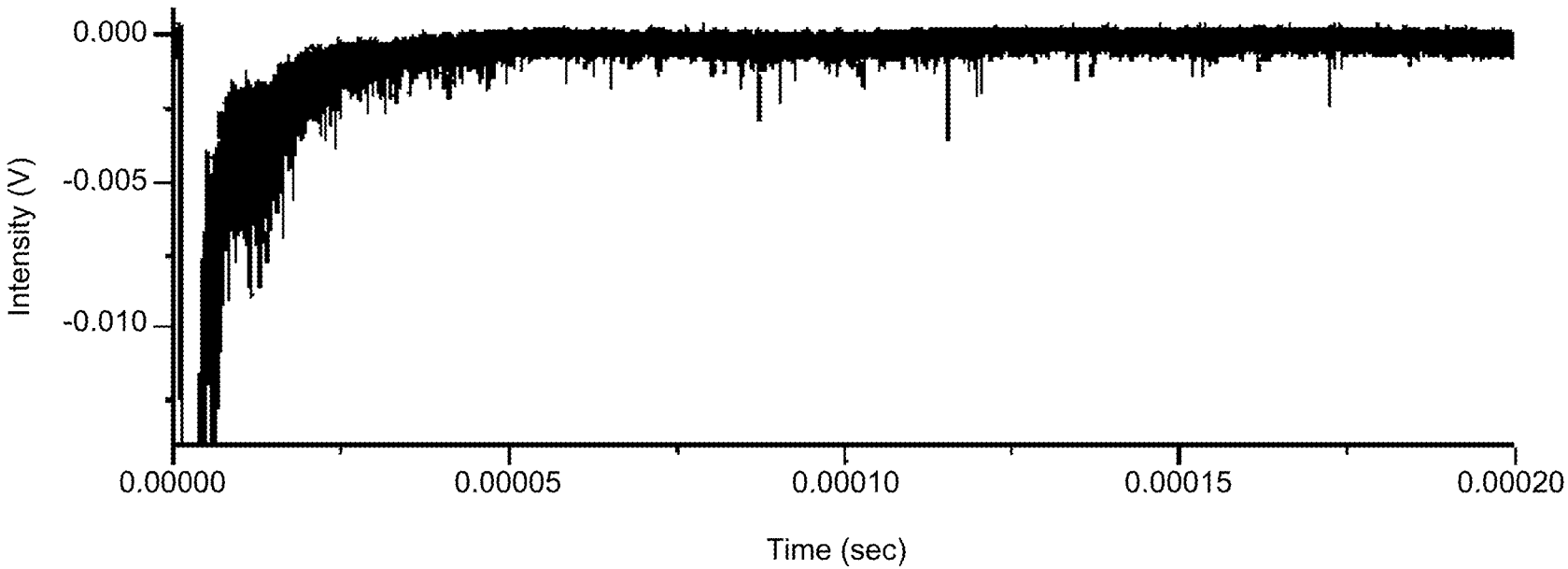
FIG. 6. Detection of fibrinogen at different levels of acceleration. Detection results are shown for fibrinogen without additional acceleration in panel A or accelerated to seven different degrees in panels B-H. No clearly distinguishable signal was detected in Panel A. Detection occurred between approximately 0.00006-0.00010 sec in each of Panels B-D.
Figure 6B:
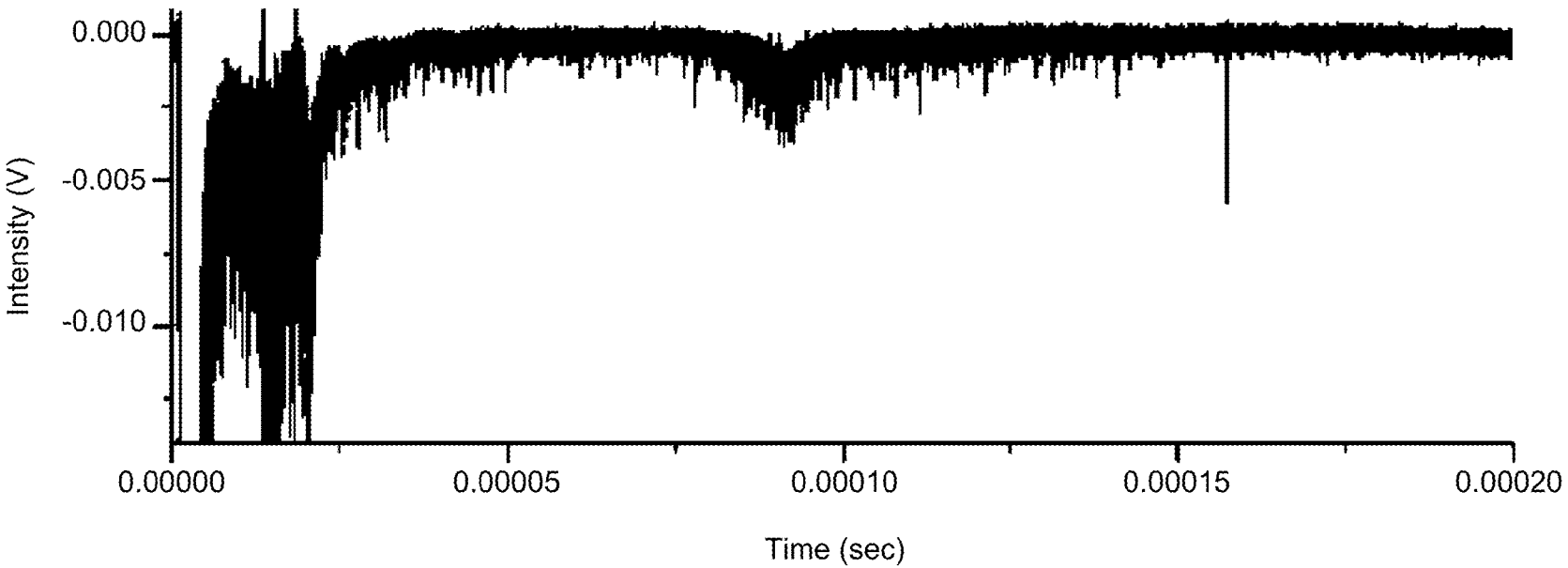
Figure 6C:
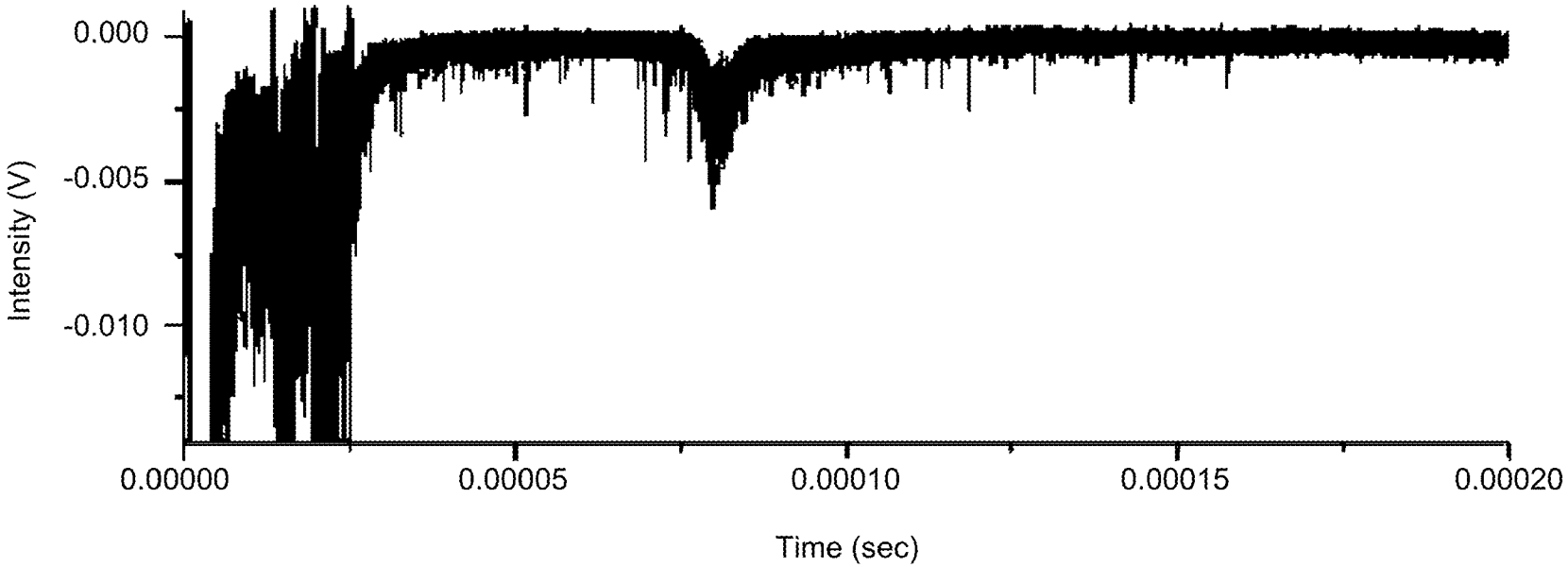
Figure 6D:
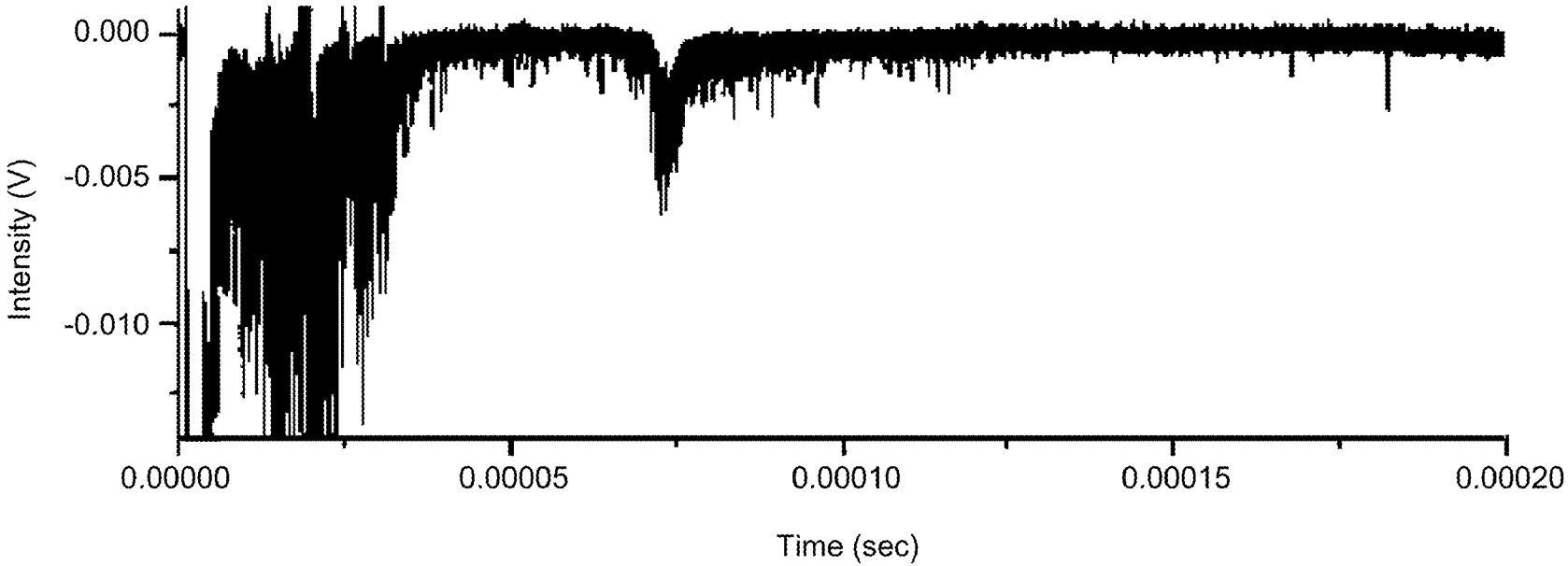
Figure 6E:
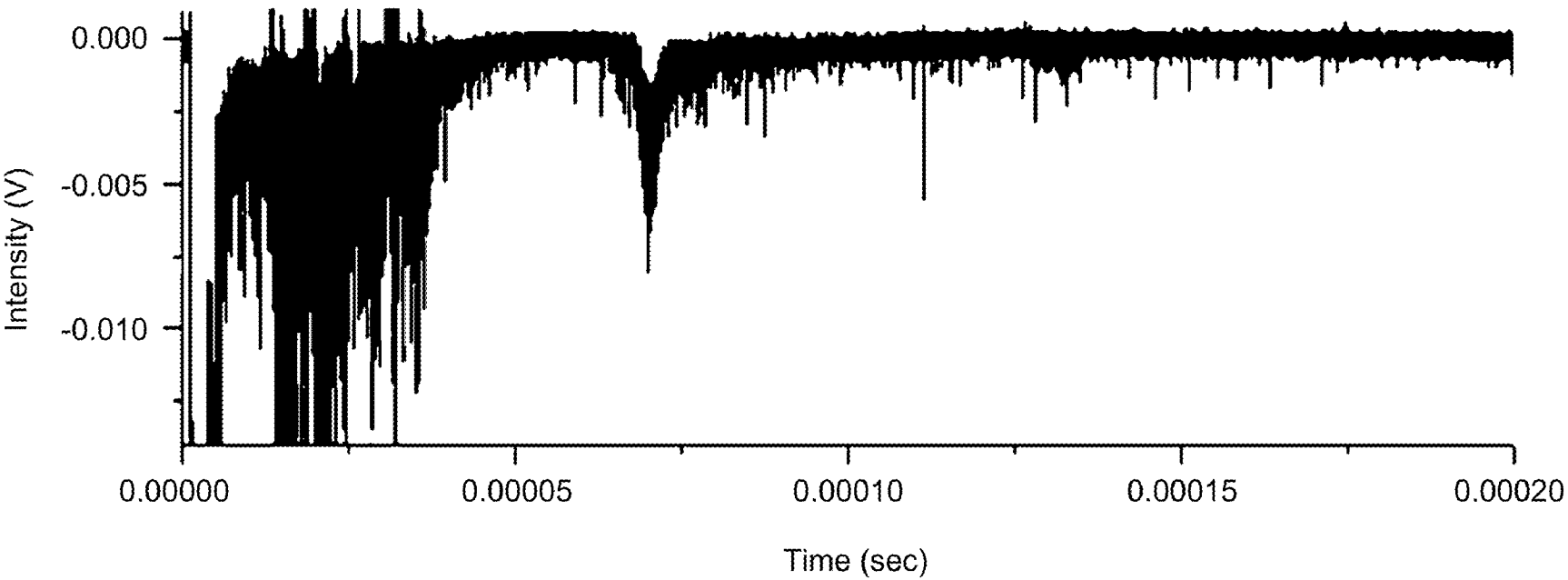
Figure 6F:
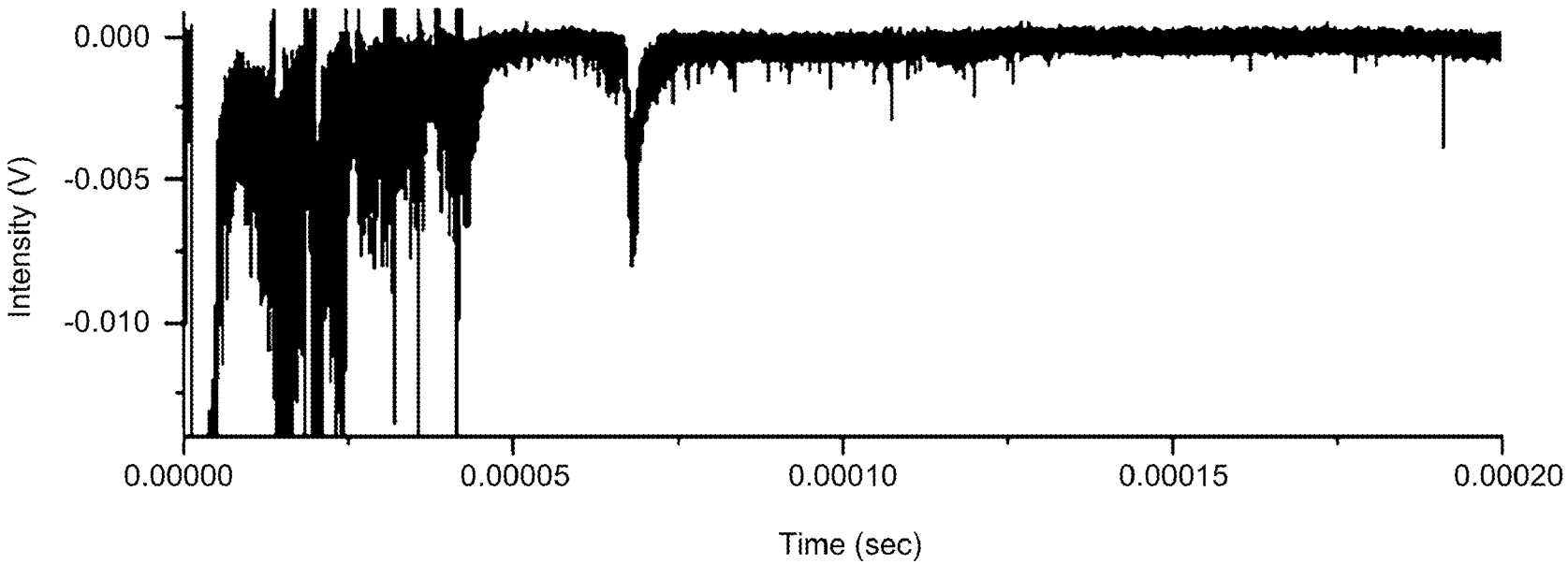
Figure 6G:
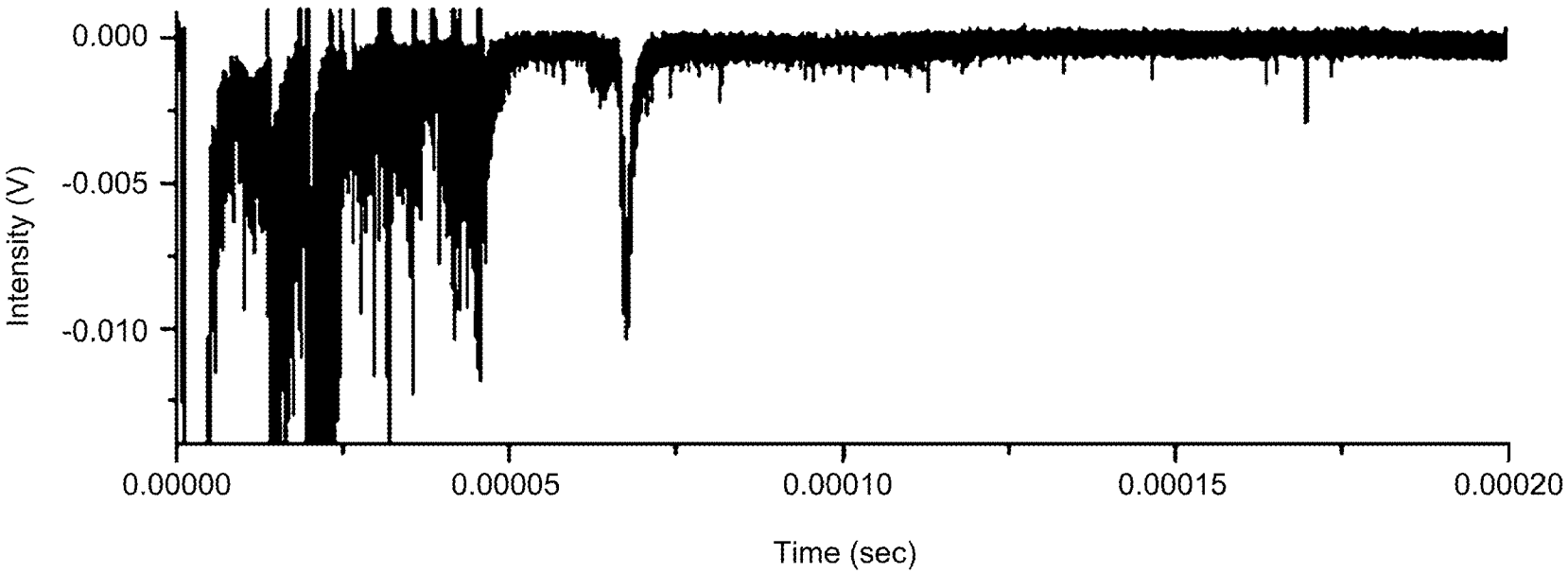
Figure 6H:
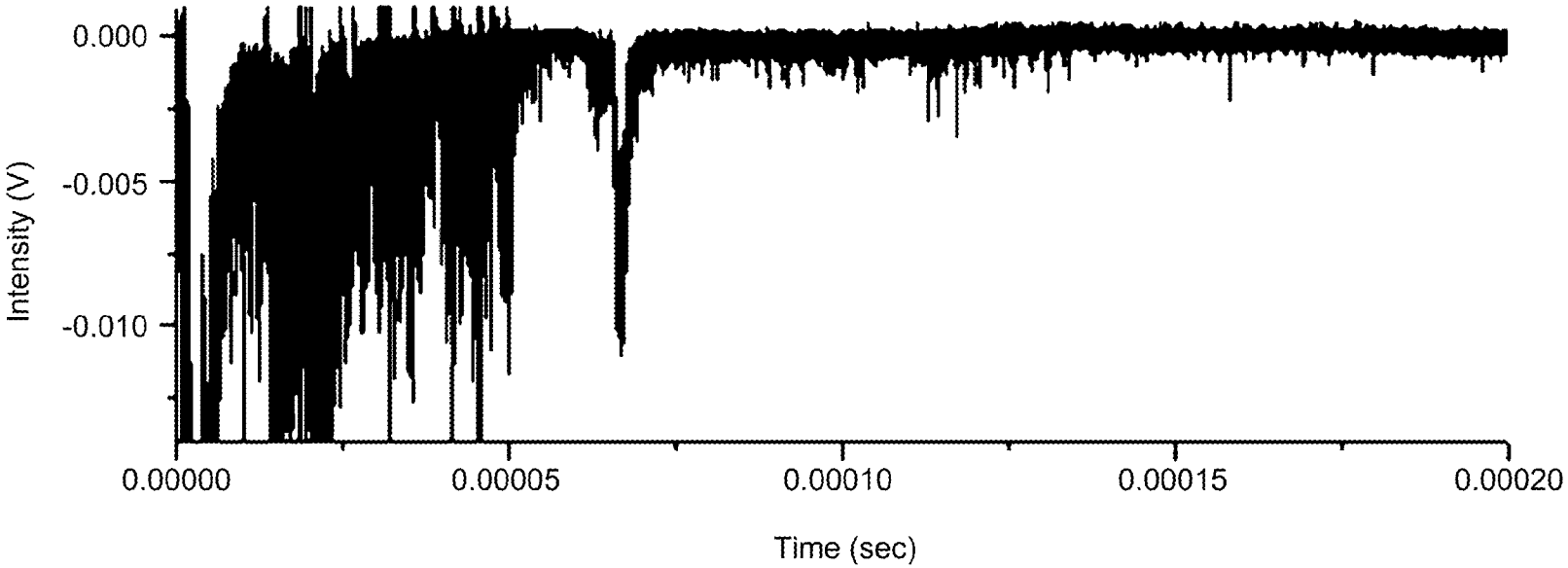

Fibrinogen was vaporized by MALDI as in Example 3. In addition to the 25 kV voltage at the sample plate, the analyte was subjected to either no additional acceleration (FIG. 6A) or a series of pulsed 30 kV voltages between individual acceleration plates. In different experiments, the series was one, two, three, four, five, six, or seven stages (FIGS. 6B-H, respectively). The approximate kinetic energy of the analyte was 25 keV in the experiment of FIG. 6A and increased by 30 keV for each stage of acceleration in an individual experiment. The detected signal intensities increased gradually with the degree of acceleration, from less than 2 mV with no acceleration beyond the 25 kV from the sample plate to approximately 11 mV with seven acceleration stages (FIG. 6H).

Example 6

Acceleration of Gold Nanoparticles

Figure 7:
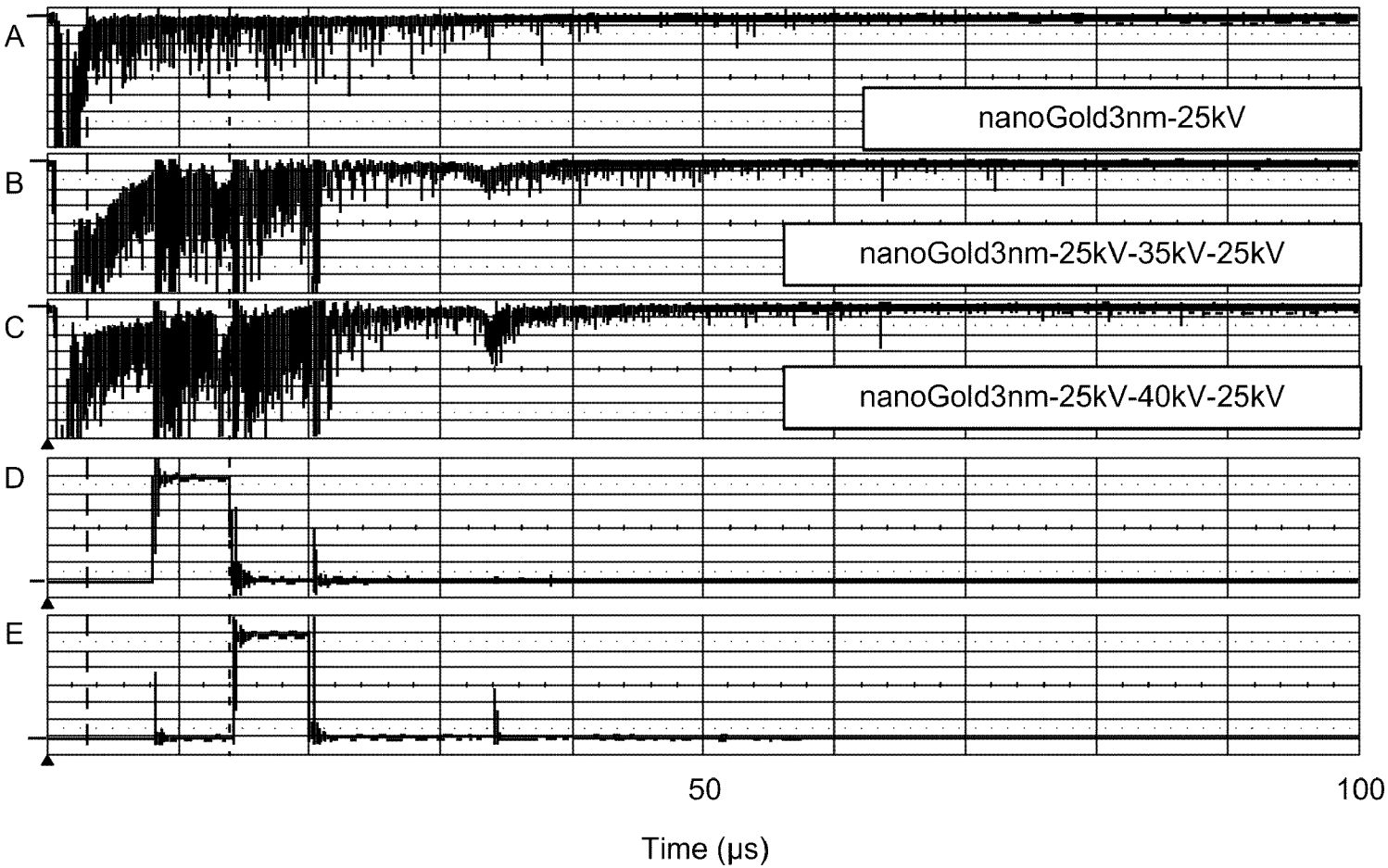
FIG. 7. Effect of acceleration on efficiency of detection of gold nanoparticles. Panels A-C show detection results of experiments where gold nanoparticles were subjected to conventional MALDI (panel A) or differing degrees of acceleration (panels B-C). The vertical scale of Panels A-C is 2 mV. Analyte signal could not be distinguished from noise in FIG. 7A. Analyte was detected at approximately 34 μs in both Panels B and C. Panel D represents function generator input for switch 1. Panel E represents function generator input for switch 2. The vertical scale of Panels D and E is 1 V.

Gold nanoparticles with an average particle weight of approximately 163 kDa were provided at a concentration of 190 ppm in water and were mixed in a 1:1 ratio by volume with a 0.2 M solution of sinapinic acid in acetonitrile and double distilled water mixed in a 1:1 volume ratio. Two microliters of this sample were vaporized by MALDI as in Example 3. In addition to the 25 kV voltage at the sample plate, the analyte was subjected to either no additional acceleration (FIG. 7A), acceleration through a 35 kV stage and a 25 kV stage (FIG. 7B), or through a 40 kV stage and a 25 kV stage (FIG. 7C). FIGS. 7D and 7E show the switch 1 function generator and switch 2 function generator outputs, respectively, for individual acceleration stages. When the analyte was not subjected to additional acceleration, a distinct signal was not distinguishable from the noise (FIG. 7A). Acceleration increased the sensitivity of detection and resulted in detection of signals of approximately 1-2 mV and 3-6 mV, both at about 34 μs (FIGS. 7B and 7C, respectively).

Example 7

Acceleration of IgM

Figure 8A:
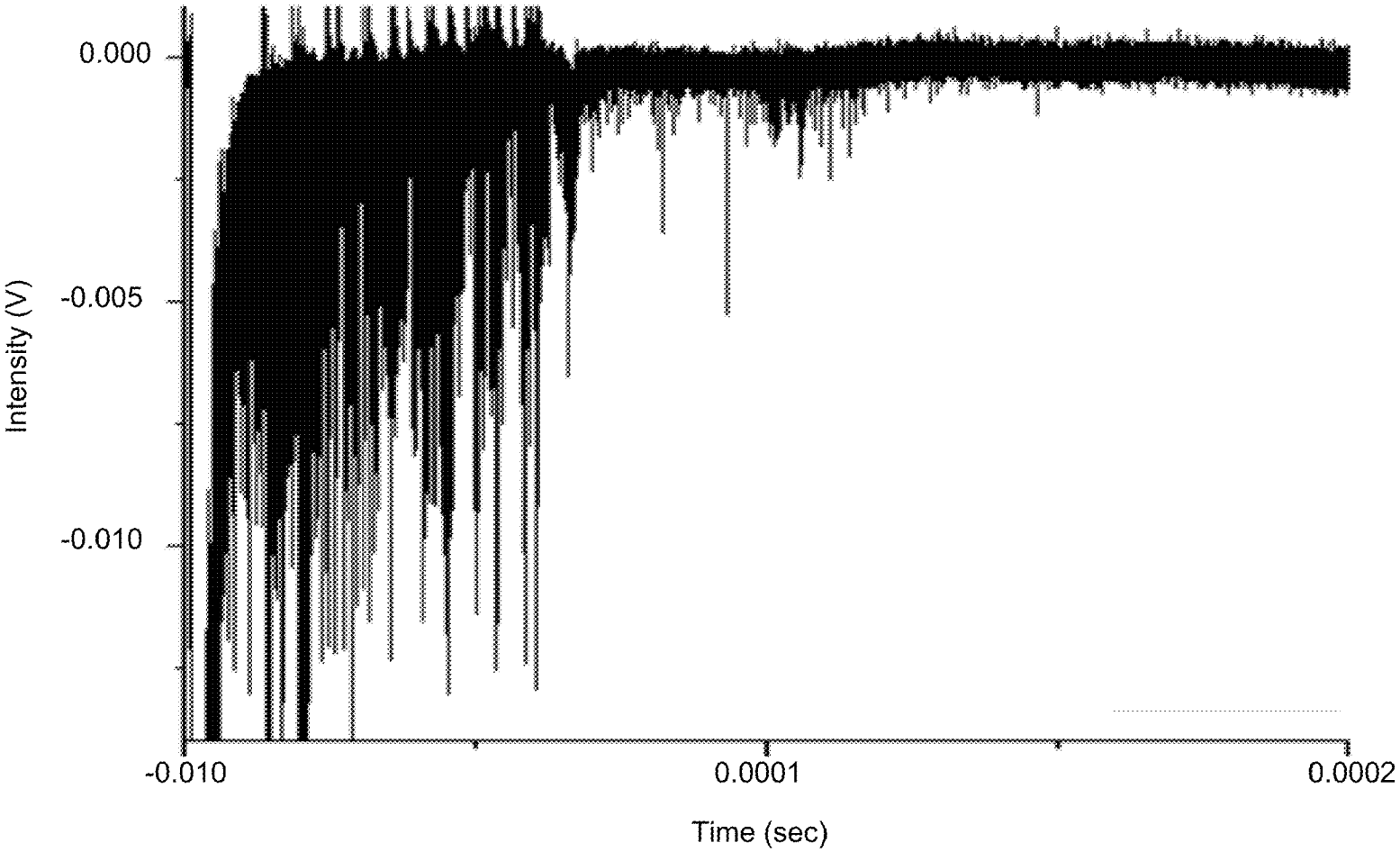
FIG. 8. Detection of IgM with and without additional acceleration. Detection results are shown for IgM without additional acceleration in panel A or accelerated through a total of 565 kV in panel B. No signal was detected in Panel A. Analyte was detected at approximately 0.00016 sec in Panel B.
Figure 8B:
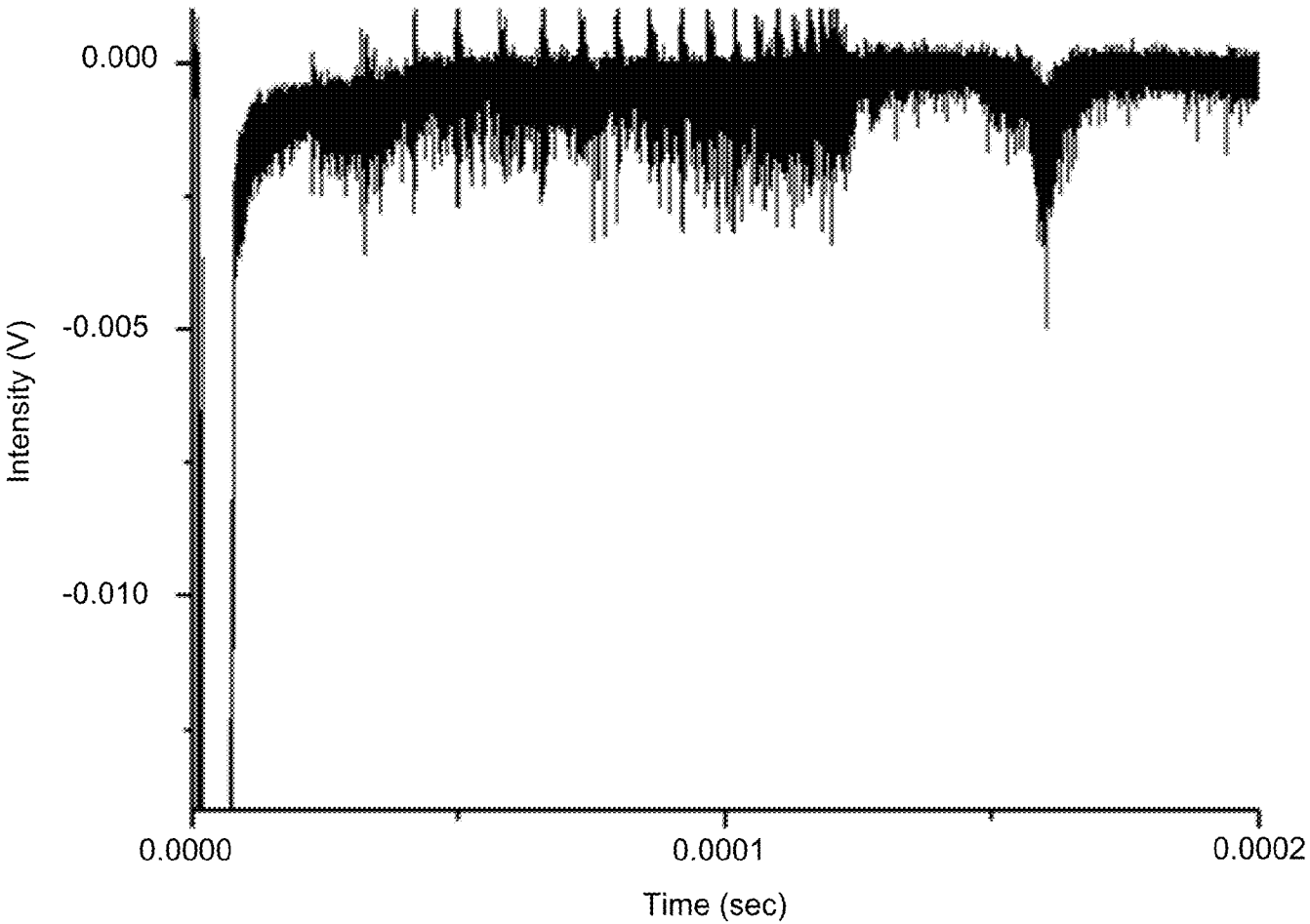

Immunoglobulin M (IgM) was vaporized by MALDI as in Example 3. In addition to the 25 kV voltage at the sample plate, the analyte was subjected to either no additional acceleration (FIG. 8A), or to acceleration through 18 stages of 30 kV each to give a total voltage of 565 kV (FIG. 8B). The additional acceleration resulted in an increase in the detected signal intensity of approximately 2-3 mV.

The embodiments disclosed above provide an illustration of embodiments of the invention and should not be construed to limit the scope of the invention. The skilled artisan readily recognizes that many other embodiments are encompassed by the invention. All publications and patents cited in this disclosure are incorporated by reference in their entirety. To the extent the material incorporated by reference contradicts or is inconsistent with this specification, the specification will supersede any such material. The citation of any references herein is not an admission that such references are prior art to the present invention.

Unless otherwise indicated, all numbers expressing quantities of ingredients, reaction conditions, and so forth used in the specification, including claims, are to be understood as being modified in all instances by the term "about."

Accordingly, unless otherwise indicated to the contrary, the numerical parameters are approximations and may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

Unless otherwise indicated, the term "at least" preceding a series of elements is to be understood to refer to every element in the series. Those skilled in the art will recognize, or be able to ascertain using no more than routine experimentation, many equivalents to the specific embodiments of the invention described herein. Such equivalents are intended to be encompassed by the following claims.

What is claimed is:

1. A method for obtaining the mass spectrum of ionized analytes, the method comprising:

a) providing ionized analytes in the gas phase at a source;

b) accelerating the ionized analytes through a series of electrodes in a linear pulsed-voltage acceleration subsystem;

c) contacting the accelerated ionized analytes with a detector, thereby obtaining the mass spectrum of the ionized analytes, wherein the ionized analytes are accelerated linearly from the source to the detector; wherein the mass spectrum has a signal of the ionized analytes at least three-fold greater than without accelerating the ionized analytes in the pulsed-voltage acceleration subsystem.

2. The method of claim 1, further comprising fragmenting the ionized analytes by collision-induced dissociation in the pulsed-voltage acceleration subsystem.

3. The method of claim 1, further comprising sorting the ionized analytes according to their mass to charge ratio before accelerating.

4. The method of claim 1, further comprising sorting the accelerated ionized analytes according to their mass to charge ratio after accelerating.

5. The method of claim 1, wherein the ionized analytes are non-monoatomic species, macromolecules, polypeptides, polynucleotides, polysaccharides, nanoparticles, microparticles, polymers, cells, viruses, chromosomes, or organelles.

6. The method of claim 1, wherein the ionized analytes have molecular weight greater than 200 Da.

7. The method of claim 1, wherein the ionized analytes have molecular weight greater than 5 kDa.

8. The method of claim 1, wherein the ionized analytes have molecular weight greater than 20 kDa.

9. The method of claim 1, wherein the ionized analytes are accelerated to a kinetic energy of at least 200 keV.

10. The method of claim 1, wherein the ionized analytes are accelerated to a kinetic energy of at least 3 MeV.

11. The method of claim 1, wherein the source comprises a laser and a desorption plate.

12. The method of claim 1, wherein the source operates by at least one of laser-induced acoustic desorption, matrix-assisted laser desorption-ionization, or electrospray ionization.

13. The method of claim 1, wherein the source operates by a mechanism chosen from surface-enhanced laser desorption-ionization, desorption-ionization on silicon, desorption-electrospray ionization, plasma desorption, field desorption, electron ionization, chemical ionization, field ionization, fast atom bombardment, ion attachment ionization, thermospray, atmospheric pressure ionization, atmospheric pressure photoionization, atmospheric pressure chemical ionization, and supersonic spray ionization.

14. The method of claim 1, wherein the source operates by a mechanism of single photon or multiphoton photoionization of analytes that are gaseous or on a surface.

15. A method for obtaining the mass spectrum of ionized analytes, the method comprising:

a) providing ionized analytes in the gas phase at a source;

b) accelerating the ionized analytes through a series of electrodes in a linear pulsed-voltage acceleration subsystem;

c) contacting the accelerated ionized analytes with a detector, thereby obtaining the mass spectrum of the ionized analytes, wherein the ionized analytes are accelerated linearly from the source to the detector; wherein the mass spectrum has a signal of the ionized analytes at least six-fold greater than without accelerating the ionized analytes in the pulsed-voltage acceleration subsystem.

16. A method for obtaining the mass spectrum of ionized analytes, the method comprising:

a) providing ionized analytes in the gas phase at a source;

b) accelerating the ionized analytes through a series of electrodes in a linear pulsed-voltage acceleration subsystem;

c) contacting the accelerated ionized analytes with a detector, thereby obtaining the mass spectrum of the ionized analytes, wherein the ionized analytes are accelerated linearly from the source to the detector; wherein the mass spectrum has a signal of the ionized analytes at least ten-fold greater than without accelerating the ionized analytes in the pulsed-voltage acceleration subsystem.

17. A method for obtaining the mass spectrum of ionized analytes, the method comprising:

a) providing ionized analytes in the gas phase at a source;

b) accelerating the ionized analytes through a series of electrodes in a linear pulsed-voltage acceleration subsystem;

c) contacting the accelerated ionized analytes with a detector, thereby obtaining the mass spectrum of the ionized analytes, wherein the ionized analytes are accelerated linearly from the source to the detector; and d) contacting the accelerated ionized analytes with a conversion dynode.

18. The method of claim 17, further comprising fragmenting the ionized analytes by collision-induced dissociation in the pulsed-voltage acceleration subsystem.

19. The method of claim 17, further comprising sorting the ionized analytes according to their mass to charge ratio before accelerating.

20. The method of claim 17, further comprising sorting the accelerated ionized analytes according to their mass to charge ratio after accelerating.

21. The method of claim 17, wherein the ionized analytes are non-monoatomic species, macromolecules, polypeptides, polynucleotides, polysaccharides, nanoparticles, microparticles, polymers, cells, viruses, chromosomes, or organelles.

22. The method of claim 17, wherein the ionized analytes have molecular weight greater than 200 Da.

23. The method of claim 17, wherein the ionized analytes have molecular weight greater than 5 kDa.

24. The method of claim 17, wherein the ionized analytes have molecular weight greater than 20 kDa.

25. The method of claim 17, wherein the ionized analytes are accelerated to a kinetic energy of at least 200 keV.

26. The method of claim 17, wherein the ionized analytes are accelerated to a kinetic energy of at least 3 MeV.

27. The method of claim 17, wherein the source comprises a laser and a desorption plate.

28. The method of claim 17, wherein the source operates by at least one of laser-induced acoustic desorption, matrix-assisted laser desorption-ionization, or electrospray ionization.

29. The method of claim 17, wherein the source operates by a mechanism chosen from surface-enhanced laser desorption-ionization, desorption-ionization on silicon, desorption-electrospray ionization, plasma desorption, field desorption, electron ionization, chemical ionization, field ionization, fast atom bombardment, ion attachment ionization, thermospray, atmospheric pressure ionization, atmospheric pressure photoionization, atmospheric pressure chemical ionization, and supersonic spray ionization.

30. The method of claim 17, wherein the source operates by a mechanism of single photon or multiphoton photoionization of analytes that are gaseous or on a surface.

* * * * *